US008516962B2

(12) United States Patent
Claeys

(10) Patent No.: US 8,516,962 B2
(45) Date of Patent: Aug. 27, 2013

(54) PRINTING CYLINDER CLEANING SYSTEM

(75) Inventor: Michael L. Claeys, Broomfield, CO (US)

(73) Assignee: Air Motion Systems, Inc., River Falls, WI (US)

( * ) Notice: Subject to any disclaimer, the term of this patent is extended or adjusted under 35 U.S.C. 154(b) by 0 days.

(21) Appl. No.: 13/597,321

(22) Filed: Aug. 29, 2012

(65) Prior Publication Data

US 2013/0068121 A1 Mar. 21, 2013

Related U.S. Application Data

(62) Division of application No. 12/177,673, filed on Jul. 22, 2008, now Pat. No. 8,281,717.

(60) Provisional application No. 60/961,969, filed on Jul. 25, 2007.

(51) Int. Cl.
*B41F 33/00* (2006.01)

(52) U.S. Cl.
USPC ..... 101/483; 101/425

(58) Field of Classification Search
USPC ..... 101/483
See application file for complete search history.

(56) References Cited

U.S. PATENT DOCUMENTS

| | | | | |
|---|---|---|---|---|
| 3,309,993 | A | 3/1967 | Grembecki et al. | |
| 4,236,450 | A | 12/1980 | Bonomi | |
| 4,393,778 | A * | 7/1983 | Kaneko | 101/425 |
| 4,747,348 | A | 5/1988 | Jeschke et al. | |
| 4,899,654 | A | 2/1990 | Hoshi et al. | |
| 5,138,945 | A | 8/1992 | Lee et al. | |
| 5,390,598 | A | 2/1995 | Stauffer | |
| 5,755,158 | A | 5/1998 | Wolfe et al. | |
| 5,848,347 | A | 12/1998 | Kuo et al. | |
| 5,887,524 | A * | 3/1999 | Seefried | 101/424 |
| 5,964,157 | A * | 10/1999 | Hummel et al. | 101/483 |
| 5,974,975 | A | 11/1999 | Seefried | |
| 6,029,575 | A | 2/2000 | Bischer | |
| 6,557,470 | B1 * | 5/2003 | Persson | 101/424 |
| 6,561,095 | B1 | 5/2003 | Michalik et al. | |
| 6,561,096 | B1 | 5/2003 | Munz | |

FOREIGN PATENT DOCUMENTS

| | | |
|---|---|---|
| JP | 11-235812 | 8/1999 |
| JP | 2002-103570 | 4/2002 |

OTHER PUBLICATIONS

Written Opinion of the International Search Authority for PCT/US/2008/070763.

Notification of Transmittal of the International Search Report and the Written Opinion of the International Searching Authority, or the Declaration for PCT/US/2008/070763.

* cited by examiner

*Primary Examiner* — Anthony Nguyen
(74) *Attorney, Agent, or Firm* — Wm. Larry Alexander

(57) ABSTRACT

A printing cylinder cleaning cylinder in one embodiment includes a base and a module reversibly attaching to the module. The module includes a housing, a module engagement-disengagement assembly, a reciprocating wiper and brush assembly, a spray discharge assembly and a discharge assembly. The reciprocating brush and wiper assemblies produce a advantageous multi-dimensional scrubbing action. The module engagement-disengagement assembly may displace the module in to an operational position. The spray assembly may deliver cleaning fluid toward the cylinder being cleaned. The discharge assembly may convey cleaning fluid away from the module after the cleaning fluid. A control system allows for automatic or semiautomatic operation is some embodiments.

11 Claims, 19 Drawing Sheets

PRINTING CYLINDER CLEANING SYSTEM

CROSS-REFERENCES TO RELATED APPLICATIONS

This is a divisional application of, and hereby incorporates by reference, U.S. patent application Ser. No. 12/177,673, filed 22 Jul. 2008, now U.S. Pat. No. 8,281,717 which, in turn, claims priority under 35 U.S.C. §119 (e) to, and hereby incorporates by reference, U.S. Provisional Application No. 60/961,969, filed Jul. 25, 2007.

FIELD OF THE INVENTION

This invention relates to printing cylinders and, in particular, this invention relates to a device and methods for cleaning printing cylinders.

BACKGROUND

Printing presses are high-throughput, high-precision machines. Modern sheet-fed presses may operate at speeds in excess of 18,000 sheets per hour (five sheets per second). These multi-color presses rely on a variety of rollers and cylinders machined to very close tolerances in order to produce high resolution imagery. Each color of ink used on a sheet-fed press has its own dedicated set of rollers and cylinders to distribute and apply the ink to the substrate. During normal operation, all types of printing inks including "conventional," "hybrid," and "UV-sensitive" types can quickly build up on these cylinders, particularly just outboard the substrate perimeter. Each time a sheet of substrate passes by, another miniscule layer of ink is usually applied to the cylinder as well. Eventually a noticeable build-up of ink forms on the cylinder. A build-up of ink only several thousandths of an inch thick can often be enough to cause an unacceptable reduction of image resolution and can also result in unwanted contamination of subsequent substrate being processed.

Volatile Organic Compounds (VOCs) are nominally identified as the family of carbon-based compounds that exhibit certain evaporation rates and/or certain photochemical reaction rates, especially those that are known to contribute to air, water, and soil pollution, and/or those that may incur serious health risks.

Conventional ink has various amounts of volatile solvents in its chemical make-up. As these solvents evaporate from the ink, the ink dries. Hybrid inks are made up of a mixture of conventional ink and UV-curable compounds, and cure partially by solvent evaporation and partially by UV-induced cross-polymerization. Both of these types of inks usually require the use of volatile solvents for clean-up. Standard equipment on printing presses includes fume hoods and other venting equipment to remove solvent vapors from the vicinity of the press and out of the building housing the press.

UV-sensitive inks typically have less than 1% VOCs. For practical purposes these inks are considered to be "VOC-free" and do not depend on solvent evaporation to dry or cure. Instead, they are formulated to cross-polymerize into a very thin film of plastic-like material when exposed to sufficient amounts of UV light energy. Upon cross-polymerization, this film coheres firmly to the substrate. UV ink is very durable and also provides a means to produce a variety of special visual effects that generally may not be obtained using other types of inks. For these reasons, UV inks are often desirable. On the other hand, cured UV ink also adheres tightly to any other nearby surface during its curing phase, including impression cylinders and the many layers of ink previously applied to impression cylinders during normal operation.

In the past, conventional ink build-up has been removed from impression press cylinders via chemical, mechanical, and/or manual means. Commercially available cleaning systems that are compatible with conventional inks depend on the use of volatile solvents.

Due to UV ink's durability and cohesive nature, the removal of the cured ink from cylinder surfaces has proven to be more tedious than the removal of conventional or hybrid inks. The use of solvents alone has varying effectiveness for removing cured UV ink from impression cylinders, so press operators often apply mechanical or manual means. Specifically, manual methodology consists of scraping the ink from the cylinder with a hand-held blade often combined with the use of aggressive volatile solvents. This process is slow and fairly tedious to perform due to limited cylinder access and restrictive press configurations. It is also fairly expensive due to the associated press down-time, requires undesirable exposure to potentially harmful chemicals and hazardous pinch points, and cleaning results often vary according to operator skill, effort, and time restraints.

Due to the design and construction of a printing press, manual cleaning is uncomfortable to perform and also presents dangerous pinch-point hazards to the maintenance personal involved with cleaning these cylinders. During cleaning, the operator must work with his hands inside a powered-up press. The phrase "pinch-point" is a bit of an understatement here since a person caught in such a "pinch-point" can potentially be pulled into the press and maimed or killed.

Like many industrial machines, printing presses are often operated around the clock. During normal operation, it is often desirable to clean the press cylinders after each job or at least on a daily basis. Because of the issues mentioned above, however, cylinder cleaning may occur only once a week or so and often a cleaning is commenced only when necessary to produce acceptable product.

SUMMARY OF THE INVENTION

In one embodiment, the reciprocating brush/wiper cleaning system described herein may be used for removing excess ink or ink build-up from cylinders in printing presses. In particular, this system may be effective for removing UV-cured ink and miscellaneous press-related debris from impression cylinders. The cleaning system will operate on an automatic or semi-automatic basis with push-button convenience and may be initiated at the discretion of the press operator. In addition to the specialized mechanical actions of the cleaning system, it is also is intended to operate using non-volatile or minimally volatile-containing solutions nominally labeled as "VOC-free," "Minimal VOC content," or "Low VOC content".

The cleaning system consists of one or more modular cleaning units which may be installed into, or removed from, a press without tools and without affecting other components of the printing press. Each module features a unique arrangement of one or more reciprocating brushes and/or one or more reciprocating wiper blades to assist with the removal of ink build-up. The action of each of these brushes and/or blades may be independent from the action of the others. The distance traveled during the stroke of these reciprocating components may be varied by changing associated drive train configuration(s). Along with these brush(es) and/or wiper blade(s), the cleaning system may utilize the application of water, compressed air, and non-volatile cleaning solution(s) to the cylinder to produce safe, reliable, and consistent cylinder cleaning.

The reciprocating motion of the brush(es) in combination with the rotational motion of a cylinder may produce a composite multi-dimensional scrubbing motion on the face of the cylinder. This composite motion closely resembles a zigzag or sinusoidal pattern and may be substantially more effective than the nominally unidirectional scrubbing pattern associated with the traditional rotary brush or reel-to-reel cleaning cloth methodology often used in the industry.

The reciprocating motion of the wiper blade, in combination with the rotational motion of a cylinder, produces a composite zigzag or sinusoidal motion to produce a more effective wiping or "squeegee" action. In particular, a single representative element on the contacting face of the wiper blade may travel in a multi-dimensional pattern rather than in the more traditional strictly circumferential pattern. If a defect, such as a notch or localized crack, is present in the blade edge, such a multi-dimensional motion may help to negate the effect of having less-than-perfect blade integrity. The composite motion may also help to reduce the amount of undesirable adherence or "stiction" that commonly occurs at metal-to-elastomer interfaces.

The brush ends, blade edge, and streams of spray may all converge at the cylinder surface in close proximity to each other to produce a compact zone of concentrated cleaning activity. This "convergence zone" may result in more efficient cleaning and drying action. This convergence zone configuration also helps to minimize physical space requirements.

The cleaning system may not be intended for use at normal printing speeds in some embodiments, but rather may be most effective at cylinder speeds in the range of approximately 1 to 50 rpm. The cylinder may be programmed via a master controller to pause as required to allow the cleaning system to work longer on those areas known to have more ink buildup. The system is also designed to accommodate the passage of the gripper fingers situated along the face of the impression cylinder. The cleaning system and its various components are chosen so that they may operate in a fail-safe mode to prevent damage to press components in the unlikely event of a malfunction.

When a plurality of dedicated cleaning modules is used in conjunction with a dedicated machine control system, a full complement of cylinders on a press may be cleaned simultaneously. The cleaning system would thus significantly reduce press downtime, minimize operator exposure to chemical and pinch-point hazards, and add considerable convenience to the cleaning process. Accordingly, the system of this invention may result in higher product throughput and better average product quality. The cleaning system may be designed to be suitable for retrofit into selected existing presses.

An automated cylinder cleaning system designed for removing cured UV ink and the miscellaneous debris that adheres to the ink is highly desirable since it may remove UV and other types of ink quickly and inexpensively per cleaning cycle. An automated system would have push-button convenience that would be highly advantageous as compared to manual methods. A cleaning cycle of this invention could be initiated after each job and could incur very little downtime on its own accord. Conceivably the cycle could occur while the press was idle for other reasons. Greater overall press productivity may result since press downtime would be minimized, cleaning consistency may be maximized, and overall average product quality may be improved.

Safe operation is another major advantage of using an automated cleaning system. Such a system may eliminate or greatly reduce operator exposure to dangerous pinch-points during cleaning operations. By virtue of the unique combination of mechanical action and the use of selected non-volatile cleaning solutions, the cleaning operation may be performed at the push of a button and without requiring the use of hazardous volatile chemicals.

Exhaust systems are often desired or necessary when volatile solvents are used in close quarters. However, an exhaust system may not be required for this cleaning system and the absence of an exhaust system may therefore help to ease cramped space concerns and reduce associated costs. Disposal and health problems associated with the use and handling of volatile chemicals may also be reduced. Accordingly, embodiments of the cleaning system of this invention may:

a. remove UV-cured inks from press cylinders in a repeatedly efficient, expedient, reliable, and more effective manner;

b. remove UV-cured inks from press cylinders with minimal operator skill and involvement;

c. remove UV-cured inks from press cylinders using cleaning fluids labeled "VOC-free," "low-VOC," or "minimal VOC;"

d. remove UV-cured inks from press cylinders with a minimum of operator exposure to hazardous pinch points;

e. remove UV-cured inks from press cylinders with minimum potential for damage to the press cylinders;

f. remove UV-cured inks from all press cylinders simultaneously.

g. remove UV-cured inks from specific press cylinders when desired and with push-button convenience;

h. remove UV-cured inks from press cylinders with significant reductions in press downtime;

i. provide a means to ensure the use of only approved cleaning solution(s);

j. provide effective cylinder drying;

k. provide the option of removing conventional and hybrid inks with similar methodology and advantages listed;

l. provide the convenience of an easily removable modular cleaning system;

m. provide relatively quick and easy module maintenance;

n. provide positional flexibility within the press;

o. provide a means for the press owner to increase throughput and improve average product quality through better press maintenance; and p. provide to the press owner a reliable and time-saving system coupled with a P. plurality of cost-saving advantages.

Accordingly, there is provided a module for cleaning a rotating printing cylinder, the module comprising a module engagement-disengagement assembly, a longitudinally reciprocating brush subassembly, a wiper subassembly, a first spray manifold, and a cleaning fluid discharge assembly. The module engagement-disengagement assembly may raise and lower the module relative to the printing cylinder. The wiper subassembly may include a longitudinally reciprocating wiper blade. The spray manifold may direct a first spray of cleaning fluid toward the cylinder.

There is also provided a cleaning system for cleaning a rotating press cylinder, which may be an impression cylinder, the cleaning system comprising a mounting base assembly and a cleaning module, the cleaning module comprising a housing, a module engagement-disengagement assembly, a reciprocating wiper and the brush assembly, a spray assembly, and a discharge assembly. The cleaning module may reversibly attach to the mounting base assembly. The module in engagement-disengagement assembly may displace the module into an operational position with respect to the cylinder. The wiper and brush assembly may be at least partially disposed within the housing. The spray assembly may deliver a cleaning fluid toward the cylinder, the discharge assembly may convey a cleaning fluid away from the module.

There is yet further provided a method of cleaning a rotating press cylinder, the method including displacing a cleaning module toward the press cylinder; directing a spray of cleaning fluid from the module toward the press cylinder; and contacting the press cylinder with a reciprocating brush and a reciprocating wiper blade, the brush and wiper blade extending from the module.

There is still further provided a method of mounting a press cylinder cleaning module to a mounting base assembly. The cleaning module may include a base plate with a longitudinal channel or a guide rail. The mounting base assembly may include the other of the longitudinal channel or the guide rail. The method may include disposing the guide rail in the channel. The module of this method may include a housing, a reciprocating wiper and brush assembly, a spray assembly delivering cleaning fluid toward the cylinder, and a discharge assembly conveying cleaning fluid away from the module.

BRIEF DESCRIPTION OF THE DRAWINGS

This invention relates to, and can be further described with reference to, the accompanying drawings, wherein like reference numerals refer to like parts in the several views.

Figure 1:
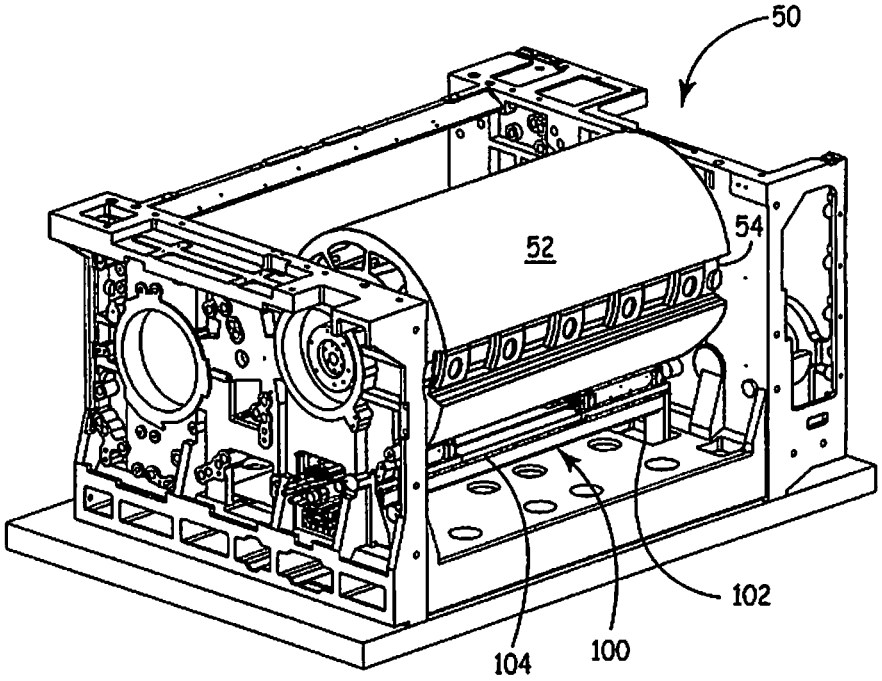
FIG. 1 is a perspective view of one embodiment of the printing cylinder cleaning system of this invention mounted to a printing cylinder press frame.

It is understood that the above-described figures are only illustrative of the present invention and are not contemplated to limit the scope thereof.

DETAILED DESCRIPTION OF THE INVENTION

Unless otherwise defined, all technical and scientific terms used herein have the same meaning as commonly understood by one of ordinary skill in the art to which this invention belongs. Although methods and materials similar or equivalent to those described herein can be used to practice the invention, suitable methods and materials are described below. The materials, methods, and examples are illustrative only and not intended to be limiting. Any references to such relative terms as left and right, bottom, upper and lower, horizontal and vertical, or the like, are intended for convenience of description and are not intended to limit the present invention or its components to any one positional or spatial orientation.

The primary purpose of this cleaning system is to remove fully cured UV-sensitive ink from printing cylinders, such as impression cylinders ("back" cylinders) of industrial sheet-fed printing presses, such removal alternatively conducted automatically. Ink removal may be accomplished, e.g., through the use of selected non-volatile cleaning solution(s) and highly specialized mechanical methodology. Another purpose of the cleaning system may be to remove conventional and hybrid inks from the impression cylinder(s) as well. The cleaning system may be configured for use on other types of cylinders present in a press.

The cleaning cycle of this invention is designed to be automated and may be selectively initiated by an operator in either fully automatic or semi-automatic mode, depending on the specific cleaning requirements at hand. The activation of a fully automatic cycle may initiate the cleaning cycle on all, or on a portion of all, cylinders simultaneously at the push of a button. The semi-automatic cycle may be cylinder-specific: a cleaning cycle may be initiated only for selected cylinder(s) while other modules located under other cylinders remain inactive. In this situation, each cleaning cycle may be individually initiated on an as-needed basis. Also in semi-automatic mode, the operator may initiate and control each sub-cycle on a step-by-step basis to perform specific set-up, testing, and various other discrete operations.

An automated cleaning system as described herein would eliminate or greatly reduce the amount of time and effort required to clean the cylinders by hand, and may greatly enhance the safety and economics of the cleaning process. Through the use of a plurality of dedicated cleaning modules (e.g., one cleaning unit per cylinder) and a dedicated control system, a full complement of cylinders in a press may be cleaned simultaneously in a relatively short period of time.

The cleaning system of this invention may include a cleaning module, a supporting structure designed to allow the cleaning module to quickly deployed and removed, and an array of pumps, solenoid valves, filters, fittings, and plumbing used to convey cleaning fluid, water, and air into, and/or out of, the module. The module may further transport ink particulates removed from the cylinder during cleaning and may collect these particulates in an external filter and/or collection tank. By virtue of the non-volatile cleaning fluid, which may be alternatively utilized, and the labyrinth-type splash guard, a vapor exhaust system may not be required in some embodiments of this invention. Quick disconnect electrical and fluid-handling fittings, if present, will allow the cleaning module to be easily placed into service and readily removed for maintenance and repair. During normal operation, tools may not be required to install or remove a module from the press.

When installed, the cleaning module is located at about the five to seven o'clock position relative to (beneath) a printing (e.g., impression) cylinder. Support equipment, such as portions of the fluid handling system and control system, may be located outside the press area in a convenient location.

Figure 2:
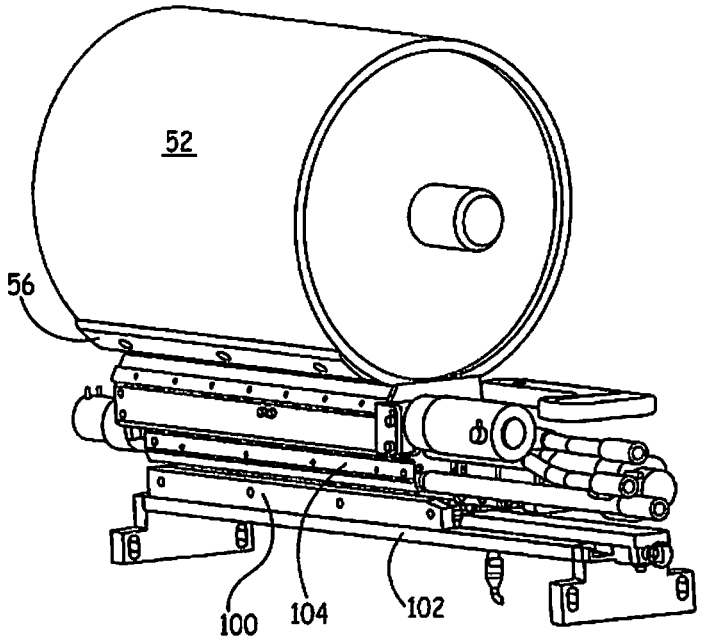
FIG. 2 is a perspective view of the printing cylinder cleaning system and printing cylinder of FIG. 1.

One embodiment of the printing cylinder cleaning system of this invention described below may be viewed in FIGS. 1 and 2 attached to a press assembly 50 as a component thereof. The press assembly 50 of FIGS. 1 and 2, in the embodiment shown, has an impression cylinder 52 with a plurality of gripper finger wells 54 and gripper fingers 56. FIG. 1 shows one gripper finger well 54, but not the gripper finger 56, which is depicted in FIG. 2. As explained in further detail below and shown in FIGS. 2 and 3, the cleaning system of this invention 100 includes a mounting base assembly 102 and a cleaning module 104.

Figure 3:
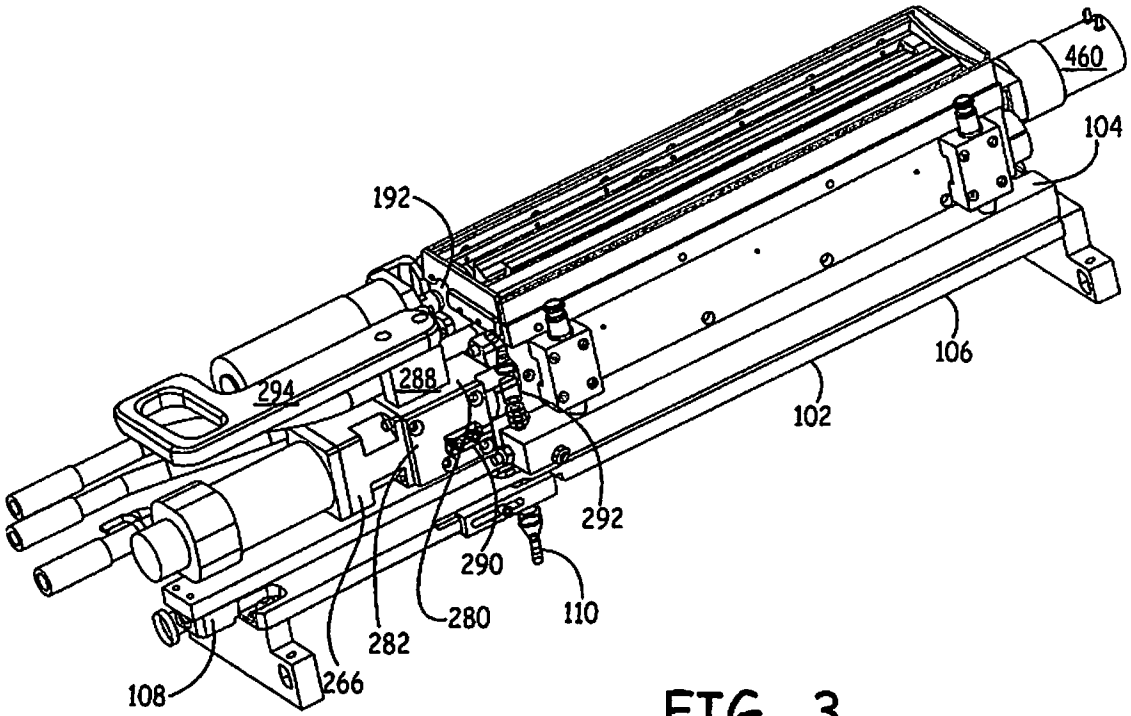
FIG. 3 is a perspective view of the printing cylinder cleaning system of FIG. 1.
Figure 4:
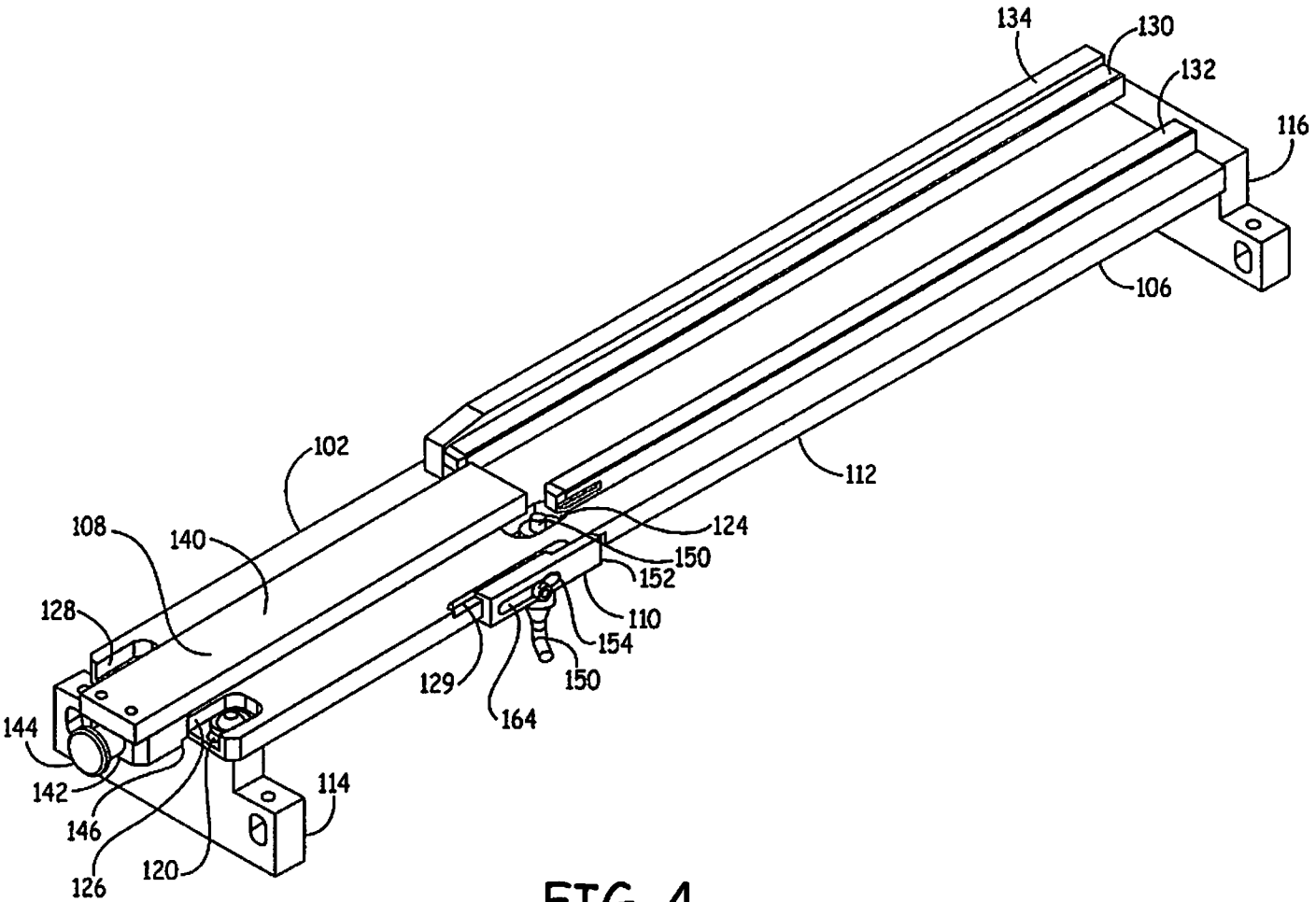
FIG. 4 is a perspective view of one embodiment of a mounting base assembly of this invention.
Figure 4A:
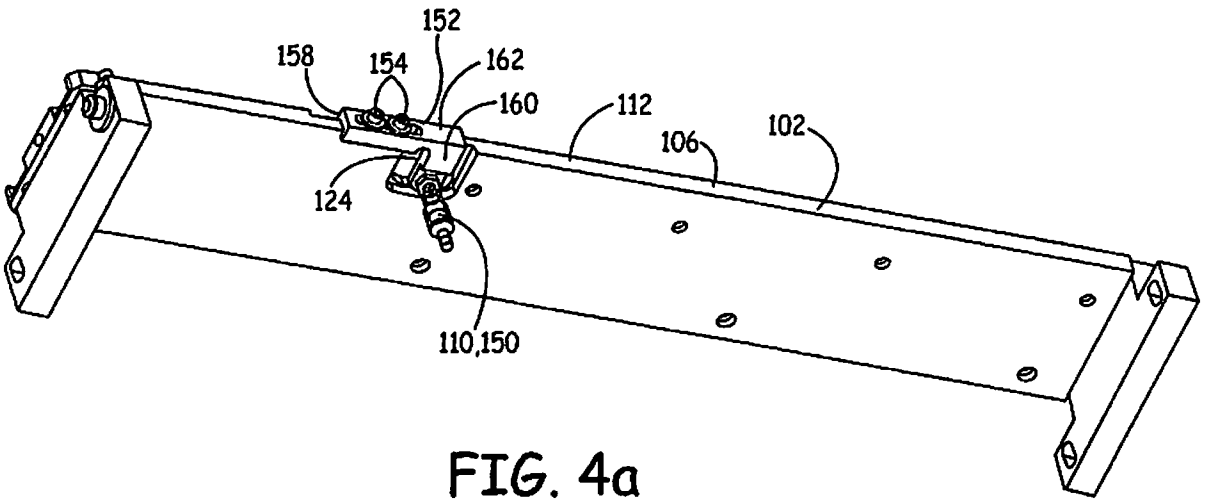
FIG. 4*a* is a perspective view of a portion of the mounting base assembly of FIG. 4.

Referring now to FIGS. 3, 4 and 4*a*, the mounting base assembly 102, in turn, includes respective baseplate, quick release, and position sensor subassemblies 106, 108, and 110. The baseplate subassembly 106 has a baseplate 112 attached to base plate supports 114 and 116 using connectors, such as threaded bolts 120. However, a person of ordinary skill in the art will readily recognize that welding or other means could readily be used for attachment. An aperture 124 is formed in base plate 112 as shown in FIG. 4 and slots 126, 128 are formed at one end of the baseplate 112, the slots 126 and 128 accommodating heads of the bolts 120. A lateral channel 129 is present to cooperate with the position sensor subassembly 110 as is further explained below. Guide rails 130, 132, and 134 are present. The guide rails 132, 134 are generally longitudinally affixed atop the baseplate 112 and the guide rail 130 extends inboard from the guide rail 134.

The quick release subassembly 108 has a quick release positioning bar 140, an adjustable block 142, and a threaded hand knob 144. Longitudinal adjustment of module positioning may be accommodated by means of stepped slots 146 present in the adjustable block 142. The hand knob 144 is attached to a threaded bolt (not shown), which extends through the adjustable block 142 and is accommodated by threads present within the baseplate 112. Accordingly, the quick release subassembly 108 is released from, and attached to, the baseplate 112 by rotating the hand knob 144 so that the threaded bolt is either seated or unseated from the threads within the baseplate 112.

The position sensor subassembly 110 has a sensor 150, a sensor mount 152 and one or more hand screws 154. The sensor mount 152, as viewed in FIG. 4*a*, has respective upper and lower lips 158, 160 extending from a main portion 162. The upper lip 158 longitudinally and adjustably seats in the channel 129 of the baseplate 112. The sensor 150 attaches to the lower lip 160, which extends below the baseplate 112 so as to position the sensor 150 with respect to the aperture 124. One suitable embodiment for the sensor 150 is an 8 mm diameter inductive proximity switch available from Turck Inc., 3000 Campus Drive, Minneapolis, Minn., which has a 2 or 4 mm sensing range. However, other suitable embodiments include physical limit switches or bifurcated light sending/receiving switches. The main portion 162 defines a slot 164, which accommodates the hand screw 154. The longitudinal position of the sensor 150 is thus adjusted by loosening the hand screw 154 and longitudinally sliding the sensor mount 152 until the sensor 150 is positioned as desired.

Figure 5:
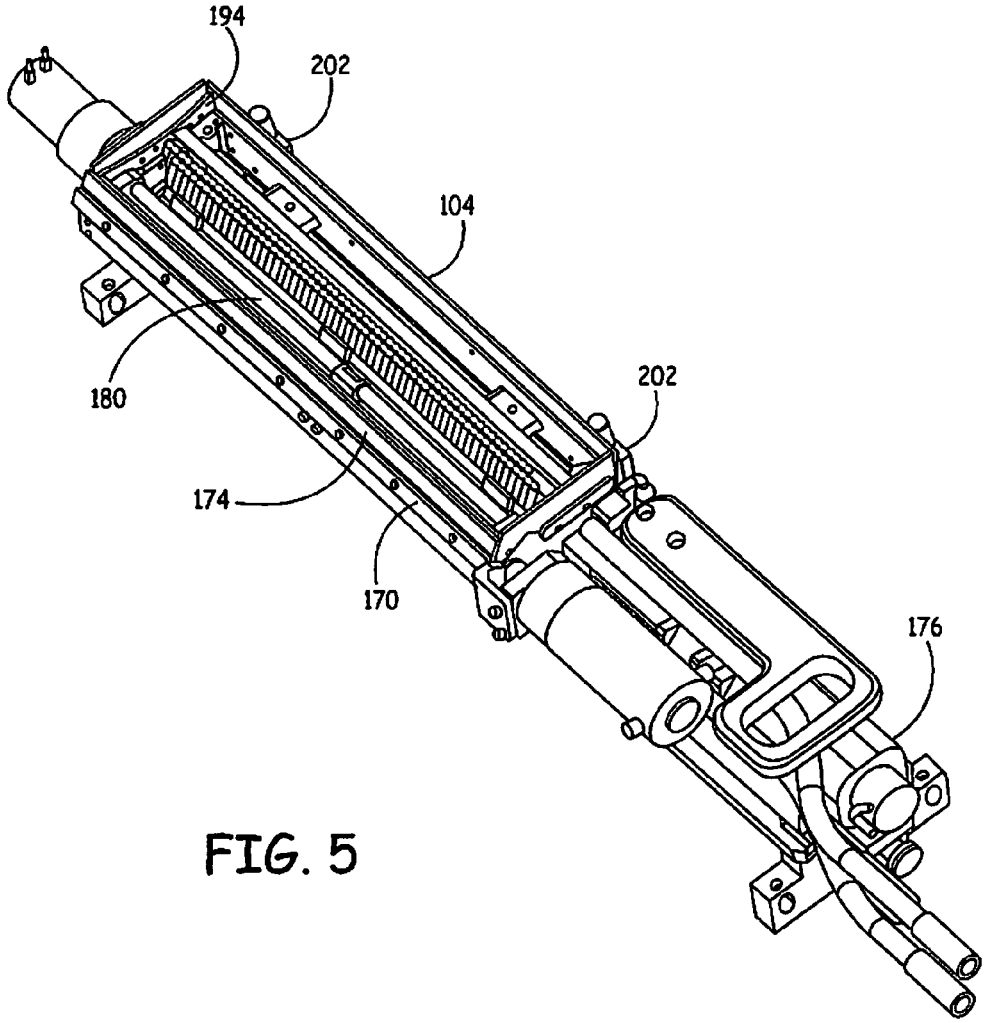
FIG. 5 is another perspective view of one embodiment of a cleaning module of the printing cylinder cleaning system of FIG. 1.
Figure 6:
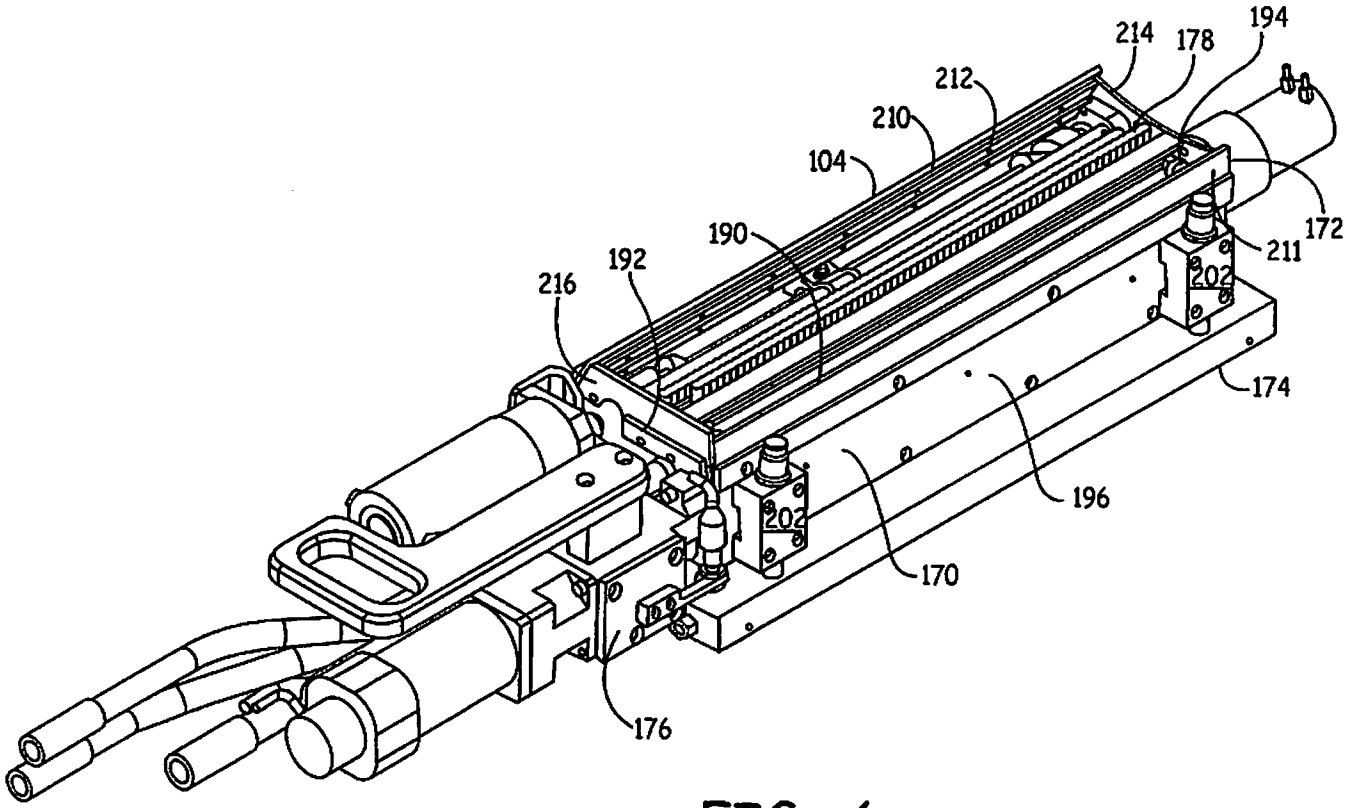
FIG. 6 is yet another perspective view of the cleaning module of FIG. 5.
Figure 7:
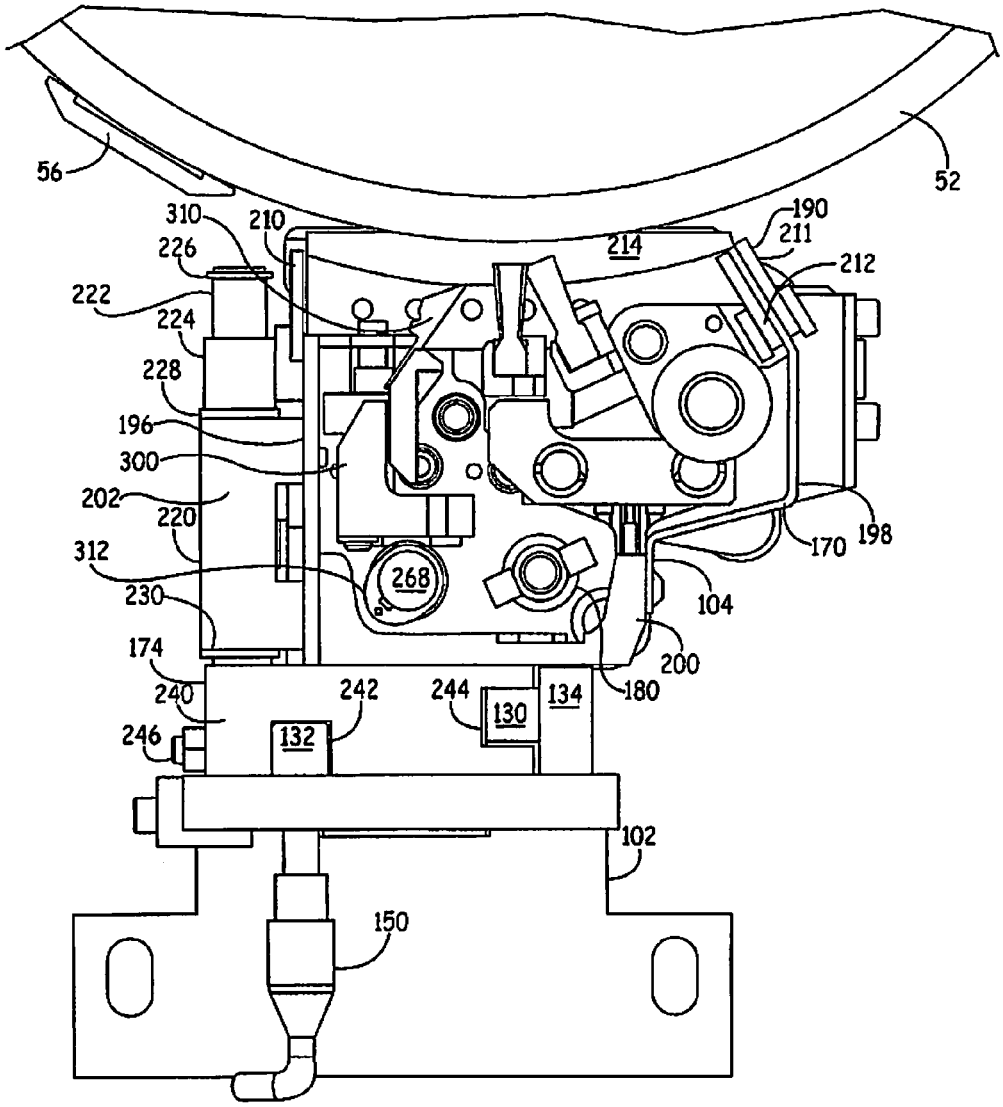
FIG. 7 is a cross sectional view of the cleaning module of FIG. 5 in a lowered position.

As can be seed in FIGS. 5, 6, and 7, one embodiment of the cleaning module 104 includes a housing or trough assembly 170, a module baseplate assembly 174, a module engagement-disengagement assembly 176, a wiper and brush assembly 178, a cleaning fluid supply and discharge assembly 180, and a controller 184 (not shown).

The housing or trough assembly 170 includes a spray guard subassembly 190, end caps 192, 194, side plates 196, 198, a trough 200, and a plurality of guide arrangement assemblies 202. The end caps 192, 194 and side plates 196, 198 extend upwardly from the trough 200 to enclose and protect the operative components of this invention and to contain and evacuate fluids during use.

Referring now to FIG. 7, the spray guard assembly 190 includes outer spray guard elements 210, 211, an inner labyrinth-type spray guard element 212, and an optional inner labyrinth-type spray guard element 213 (not shown), and cylinder end seals 214, 216 (cylinder end seal 216 shown in FIG. 6). The outer spray guard element 211 and the inner labyrinth-type spray guard element 213 are attached to, and spaced apart by, an upper portion of the side plate 198. The outer spray guard element 210 is attached to an upper portion of the side plate 196. If present, the inner labyrinth-type spray guard element 213 is also attached to, and spaced apart from the outer spray guard element 210 by, the upper portion of the side plate 196. The end seals 214, 216 are respectively attached to upper portions of the end caps 192, 194. The inner labyrinth type spray guard elements 212, 213 define openings, such as slots (not shown) to allow cleaning fluid drainage.

As described above, the cleaning module 104 of this invention may incorporate a labyrinth-type spray guard 212 situated about the upper perimeter thereof to minimize the amount of fluid or other liquid escaping from the module during cleaning and rinsing cycles. In one embodiment, the spray guard assembly of this invention may include a synthetic resin such as synthetic rubber elements designed and shaped to operate in close proximity to, but not touch, the impression cylinder. Other synthetic resins suitable for use in this and other embodiments of the spray guard elements 210, 211, 212, 213 and the instant wiper blade (described below) may be found in the Handbook of Plastics, Elastomers, and Composites, Third Edition, Charles A. Harper, Editor in Chief, McGraw-Hill, New York (1996), hereby incorporated by reference. A plurality of individual spray guard elements may be arranged around the module and may feature a small space between adjacent spray guard elements to effect the labyrinth configuration and functionality. Accordingly, the spray droplets not stopped by a first element may be prevented from escaping the module by a subsequent element. Accordingly, liquids flowing from the spray guard combination described above continue to flow by gravity to the bottom of the module cavity, where they egress the instant module as described below.

Each of the guide arrangement assemblies 202 includes a bearing housing 220, shaft 222, compression spring 224, and retaining rings 226, 228, 230. The bearing housing 220 mounts to the side plate 196 and houses a bearing arrangement therewithin. The shaft 222 is accommodated within the bearing housing 220, such that the shaft 222 axially displaces within the bearing arrangement disposed within the bearing housing 220. The shaft 222 is also disposed within the compression spring 224 and the compression spring 224 is held in place by the retaining rings 226, 228. An additional retaining ring 230 attaches to a lower portion of the shaft 222 to thereby secure the shaft 222 within the bearing housing 220.

The baseplate assembly 174 as depicted has a baseplate 240, which defines channels 242, 244. The channel 242 opens downwardly so as to accommodate the guide rail 132 and the channel 244 opens laterally to accommodate the guide rail 130. However, a person of ordinary skill in the art will readily recognize that the guide rails could be present on the module and the channels 242, 244 could be present in the mounting assembly baseplate. A threaded lateral aperture (not shown) may be present in the channel 242 to accommodate a set screw 246. A threaded axial aperture may also be present in the channel 242 to accommodate an optional and adjustable spacer, such as a set screw 248 (not shown). The set screw 246, when present, may be used to secure the guide rail 132 in place and the axial set screw 250, when present, may be adjusted to longitudinally position the cleaning module 104 when attached to the mounting base assembly 102. The cleaning module 104 is mounted to the mounting base assembly 102 to slide longitudinally such that guide rails 130, 132 are accommodated in channels 244, 242, respectively. The positioning of the mounted module 104 is verified by the sensor 150, which when the module is correctly positioned, allows the module to be actuated, but will not do so when the module is incorrectly positioned. When the module is correctly positioned and mounted, the set screw 246 is tightened to secure the module in place. When the module is detached from the mounting base assembly, the set screw 246 is loosened and the module is displaced longitudinally until the guide rails 132, 130 are no longer disposed in the slots 244, 242.

As seen in FIGS. 7, 8, 9, and 10, the module engagement-disengagement assembly 176, in the embodiment depicted, has an engagement-disengagement drive motor 260, gearbox 262, coupling 264, motor mount housing 266 (see FIG. 3), shaft 268, housing lift-lower cams 270, 272, and cam followers 274, 276. The engagement-disengagement drive motor 260 may be a servo (or stepper) motor, e.g., an electric motor having a 10:1 ratio, part number 23SP010 from Carson Manufacturing Inc., Carson City, Nev. When activated, the motor 260 rotationally operates gears disposed within the gear box 262. The shaft 268 is attached to the coupling 264, the coupling 264 attaching to the gear box 262. The cams 270, 272 accommodate the shaft 268 in an off-center (eccentric) manner and are rotated by the shaft 268. The cam followers 274, 276 are rotationally mounted to the baseplate 240 and are positioned so as to be rotated by the cams 270, 272. The motor mount housing 266, in the embodiment shown in FIG. 3, includes an upper member 280, side members 282, 284 (side member 284 not shown), a lower member 286 (not shown), a handle block 288, a sensor bracket 290, a sensor 292, and a handle 294. The side member 282 attaches to the end cap 192 and the upper and lower members 280, 286 attach to the side member 282. The side member 284, in turn, attaches to the upper and lower members 280, 286. The handle block 288 attaches to, and spaces the handle 294 away from, the upper member 280. The handle 294 is attached to, and axially extends from, the upper member 280. The handle may be used to mount and remove the module 104 from the base plate assembly 102, e.g., in a manner as described above.

Figure 8:
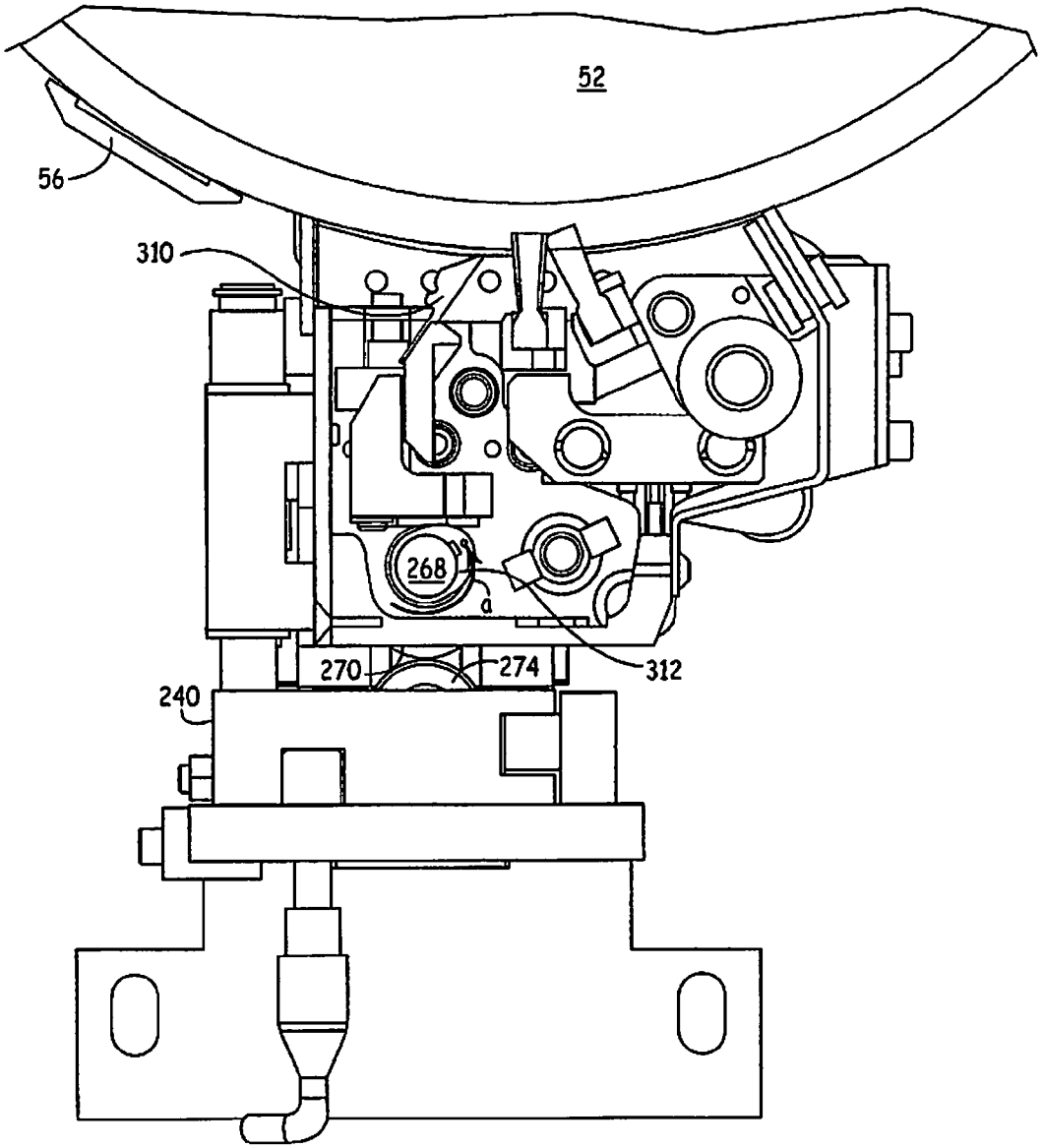
FIG. 8 is a cross-sectional view of the cleaning module of FIG. 5 in a position intermediate between a lowered and raised position.
Figure 9:
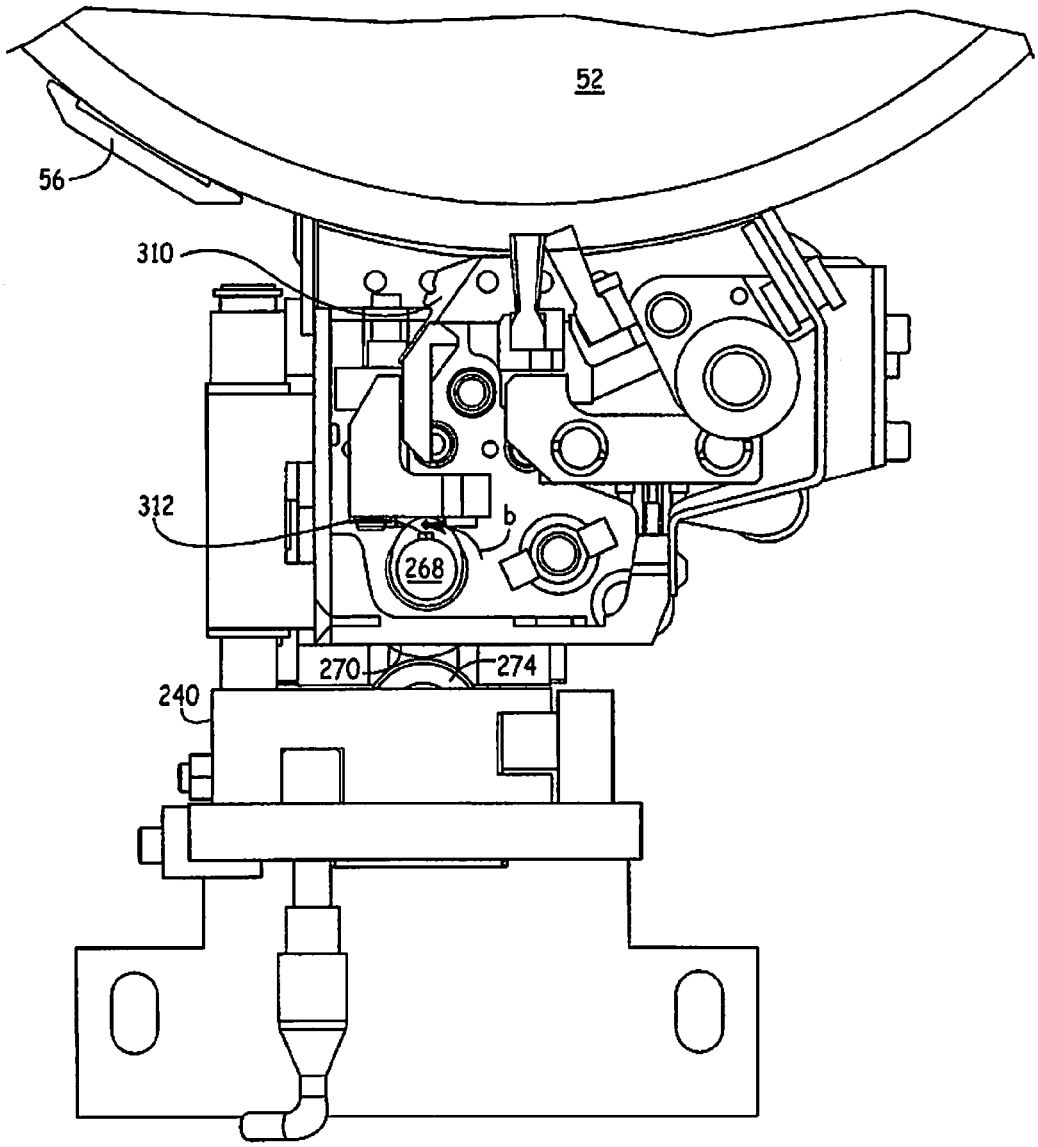
FIG. 9 is a cross-sectional view of the cleaning module of FIG. 5 in a raised position.
Figure 10:
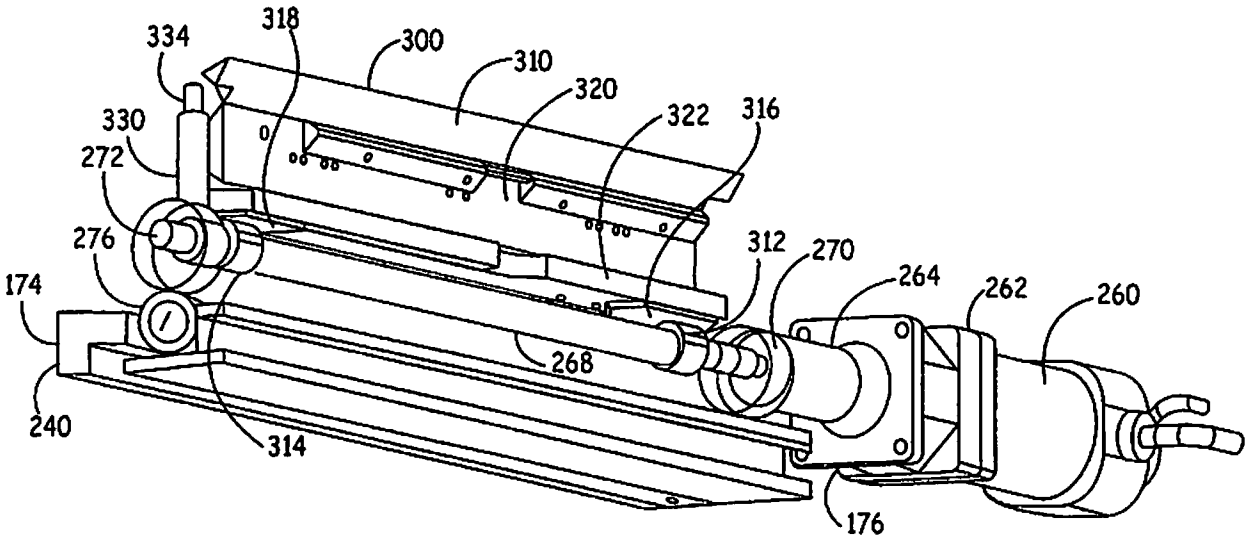
FIG. 10 is a perspective view of a portion of one embodiment of the wiper cam and drive arrangement of the printing cylinder cleaning system of this invention.
Figure 11A:
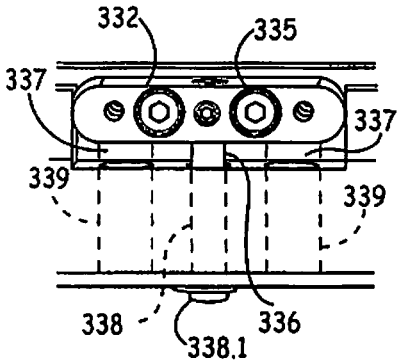
FIG. 11*a* is a side view of a portion of the wiper cam and drive arrangement of FIG. 11.
Figure 11:
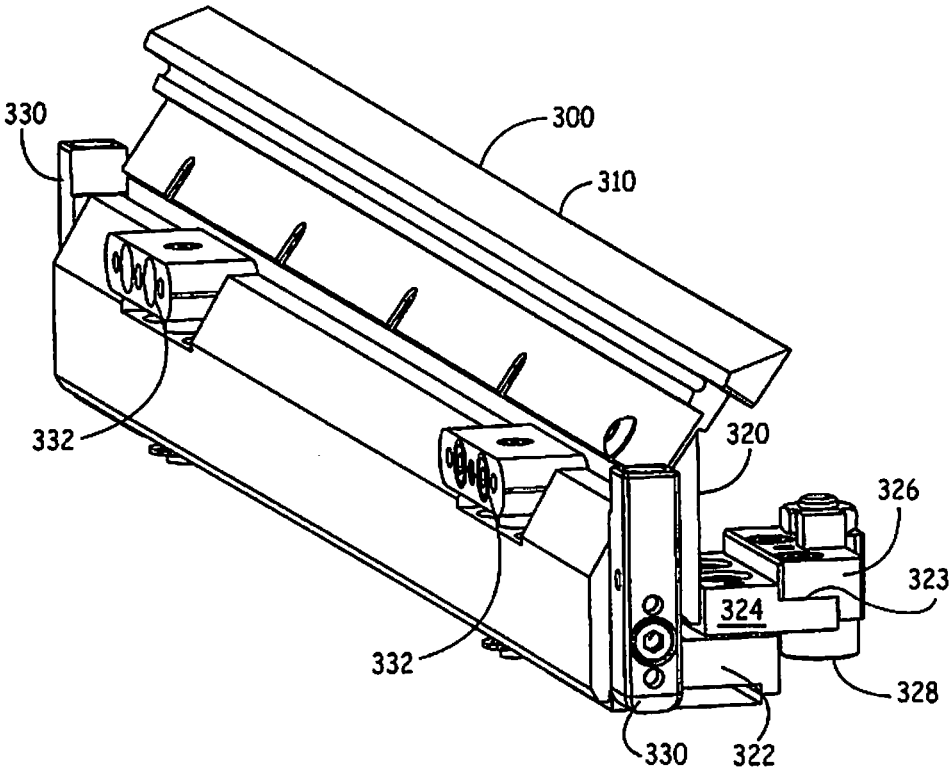
FIG. 11 is another perspective view of a portion of one embodiment of the wiper cam and drive arrangement of the printing cylinder cleaning system of this invention.
Figure 12:
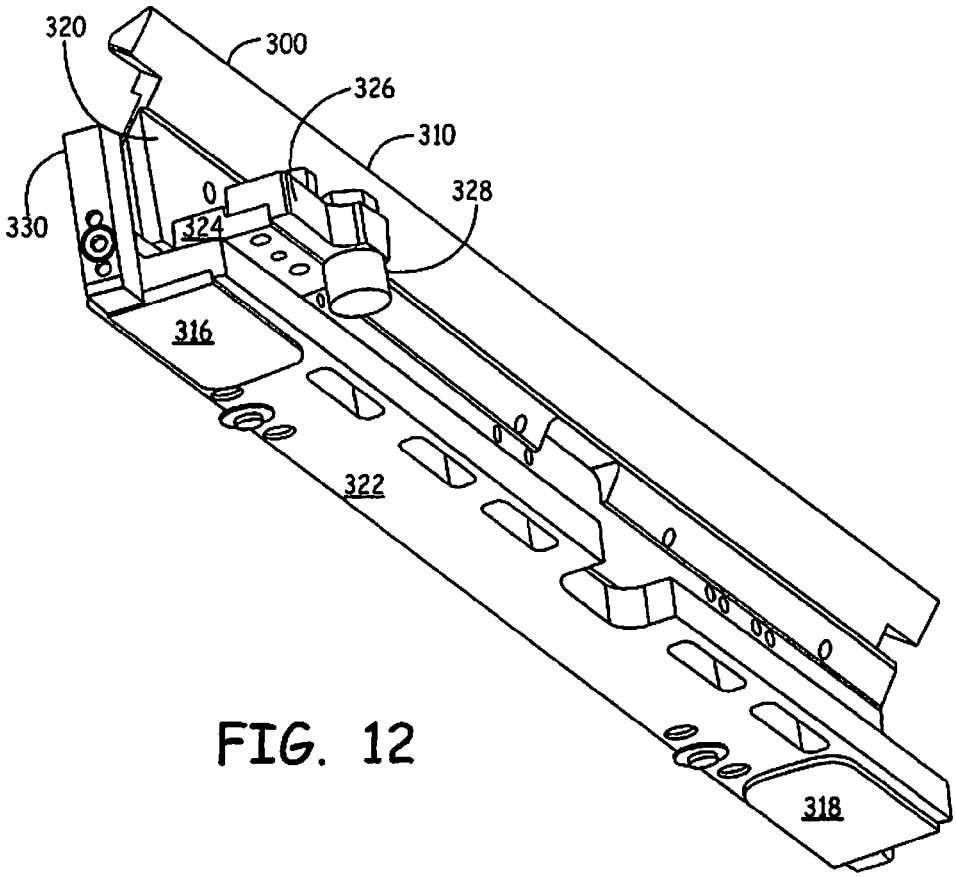
FIG. 12 is a bottom perspective view of a portion of the wiper cam and drive arrangement of the printing cylinder cleaning system of FIG. 11.

In one embodiment of this invention, the camshaft 268 driven by the servo (stepper) motor 260 lifts and lowers the cleaning module 104 of this invention, as well as independently lifting and lowering some of the internal components thereof. On the camshaft 268 may be mounted multiple sets of cams. One set of cams 270, 272 lifts and lowers the entire module 104 into place under the cylinder 52 being cleaned during the cleaning, rinsing, and a drying cycles. A second set of cams 312, 314 (described below) lifts and lowers the wiper blade assembly only. With this arrangement, the module may remain in the raised position required during all cycles, while the wiper blade 310 of this invention (more fully discussed below) may be independently raised and lowered as desired. FIG. 7 shows the module 104 in a lowered position before being actuated. Rotating the cam 268 counterclockwise a first arc a from that shown in FIG. 7 elevates the module 104 to a mid-position as shown in FIG. 8, in which the module, but not the wiper assembly, is fully raised. Actuation of the wiper assembly is more fully described below.

Figure 13:
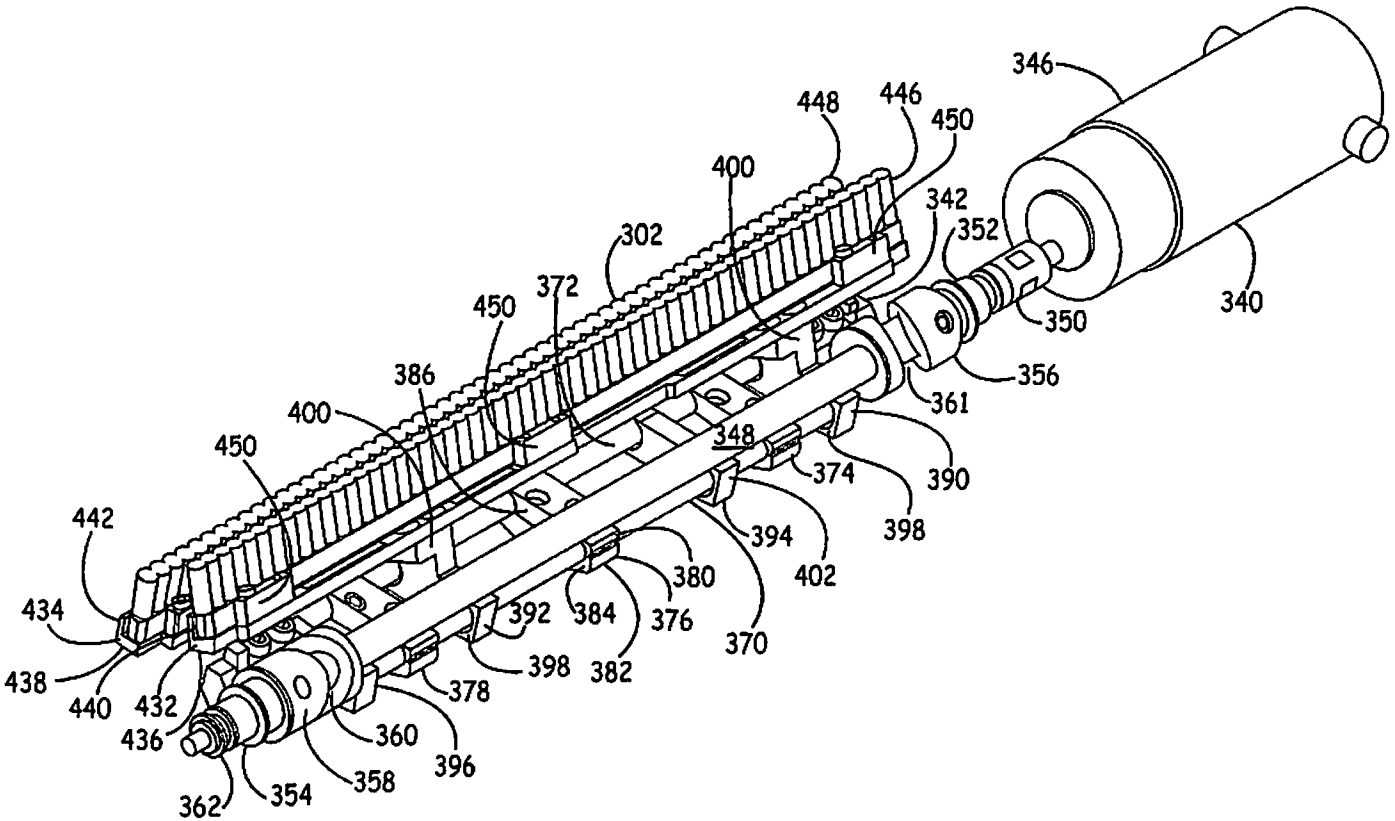
FIG. 13 is a perspective view of a portion of the brush-cam arrangement of the printing cylinder cleaning system of FIG. 1.
Figure 13A:
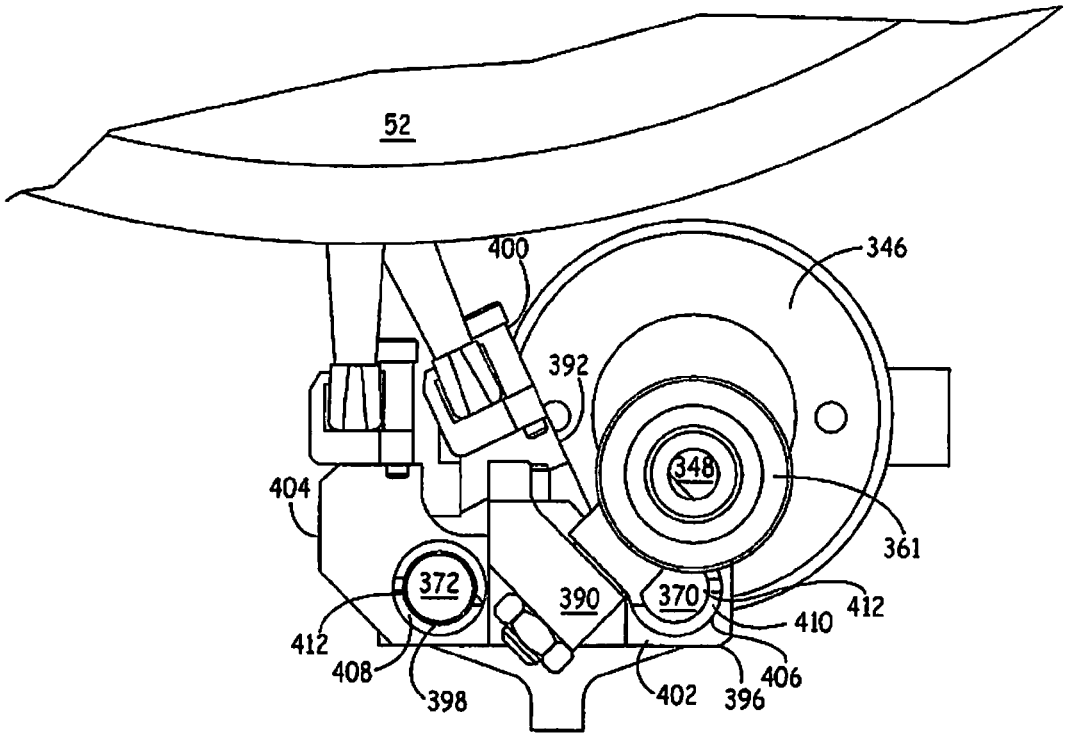
FIG. 13*a* is an end view of the brush cam arrangement of FIG. 13.
Figure 14:
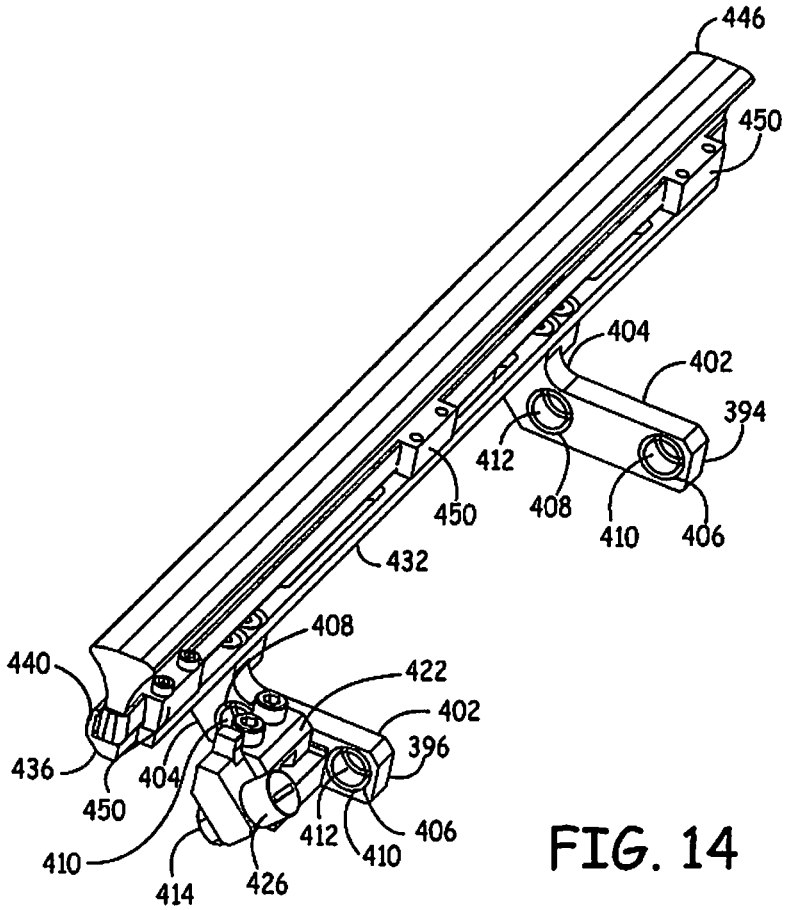
FIG. 14 is a perspective view of a portion of the outer brush cam arrangement of FIG. 13.
Figure 14A:
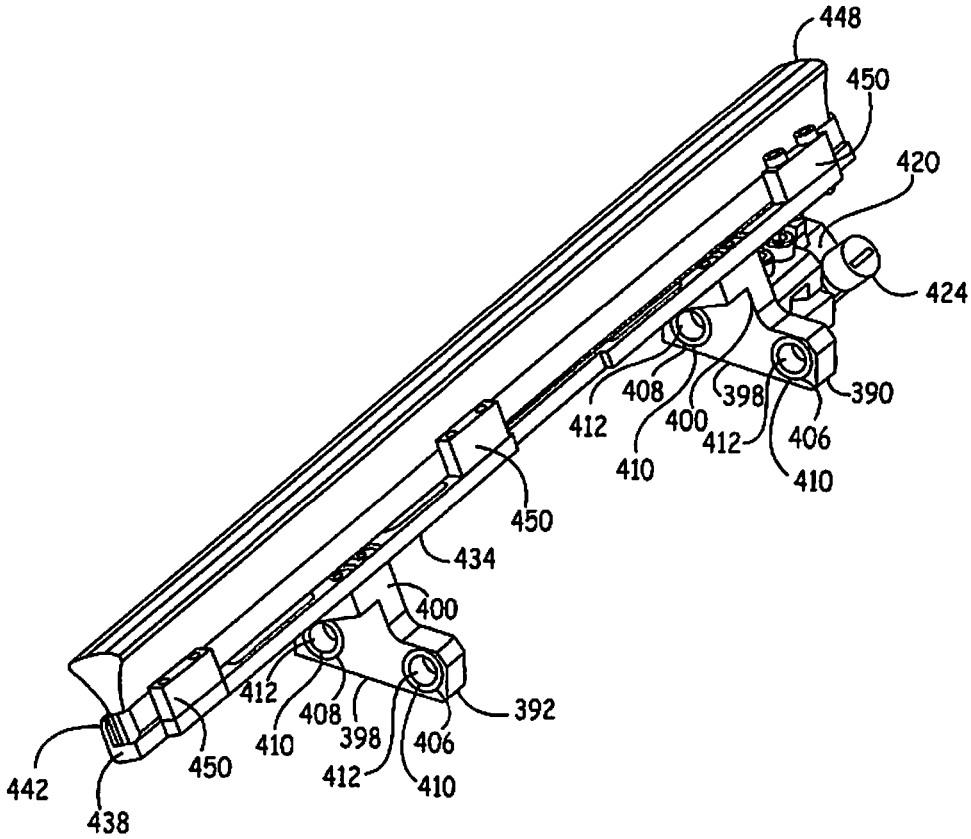
FIG. 14*a* is a perspective view of a portion of the inner brush cam arrangement of FIG. 13.

As seen in FIGS. 7, 8, 9, 10, 11, 11*a*, and 12, an embodiment of the wiper and brush assembly 178 includes a wiper subassembly 300 and a brush subassembly 302 (FIG. 13). The wiper subassembly 300 is also operated by the drive motor 260 and has a wiper blade 310, wiper cams 312, 314, wiper cam (e.g., bronze) bearings 316, 318, a blade mount 320, a blade mount angle bracket 322 respective first and second cam follower mounting brackets 324, 326, a wiper cam follower 328, a plurality of, e.g. two, vertical guides 330, and a plurality of, e.g., two compound connectors 332. The wiper cams 312, 314 are mounted on the shaft 268. The wiper cam bearings 316, 318 are attached to a lower side of the blade mount angle bracket 322. The wiper blade 310 is attached to the blade mount 320 by means of fasteners, such as screws in the embodiment shown. The first cam follower mounting bracket 324 is attached to an upper surface of the blade mount angle bracket 322. The second cam follower mounting bracket 326 is attached, e.g., with fasteners such as screws, to an upper stepped surface 323 of the first cam follower mounting bracket 324. The wiper cam follower 328 is attached to the second bracket 326, for example by using a connector such as a nut. A vertical guide 330 is pivotally attached to each end of the blade mount angle bracket 322 and may be slidably mounted to each end cap 192, 194. A compression spring 334 is disposed within, and extends upwardly from, the vertical guide 330. The compression spring 334 is biased against a plate (not shown) attached to an upper edge of each end cap 192, 194. Accordingly, the compression spring 334 biases the vertical guide 330, hence, the blade mount angle bracket 322, downwardly. Each of the compound connectors 332 includes an inverted guide rod mount 335, a guide rod 336, and a plurality of, e.g., two compression springs 337. Each inverted guide rod mount 335 attaches to the blade mount 320, e.g., by using connectors such as screws. The guide rod 336 extends downwardly from the guide rod mount 335 and through a bore 338, the bore 338 defined in, and extending through, the blade mount angle bracket 322 and is maintained in position therein by a snap ring 338.1 or, alternatively, the guide rod 336 may have a distal end portion with an increased radius. The compression springs 337 extend downwardly from the guide rod mount 335 and are housed within bores 339. The compression springs 337 within the compound connectors 332 thus bias the blade mount 320 upwardly with respect to the blade mount angle bracket 322.

Returning to FIGS. 8 and 9, as the shaft 268 is further rotated a second arc b from the position shown in FIG. 8 to the position shown in FIG. 9, the wiper subassembly 300, hence the wiper 310 is raised to contact the cylinder 52 during phases of the cleaning cycle as is more fully described below. Consequently, wiper subassembly 300 can be raised and lowered independently of the raising and lowering of the entire module 104, the independent raising and lowering, however, accomplished by the same drive mechanism.

Referring to FIGS. 13, 13*a*, 14 and 14*a*, the brush subassembly 302 depicted may be considered to have a brush drive 340 structure and a brush support 342. The brush drive structure 340, in turn, has a drive motor 346 attached to a camshaft 348 by a coupling 350. The camshaft 348 extends through the flange bearings 352, 354. The flange bearings 352, 354 may be seated in the end caps 192, 194 and provide an inner bearing surface when the camshaft 348 is rotated. Barrel cams 356, 358 are mounted to the camshaft 348. Each of the barrel cams 356, 358 defines a channel or groove 360, 361. As can be seen, the barrel cam 358 is inversely mounted to the camshaft 348 relative to the barrel cam 356. Accordingly, the channels 360, 361 diverge as viewed from FIG. 13. In the embodiment shown, one or more seals, such as O-rings 362 are mounted on the camshaft 348 opposite the drive motor 346. A suitable embodiment for the drive motor 346 has the part number GM14904S015-R1 and is a 24 VDC motor having a 19.7 ratio and available at Pittman Corp. Inc. Harleyville, Pa.

The brush support 342 has a pair of brush support guide rails 370, 372 held in position by clamps 374, 376, 378. Each of the clamps 374, 376, 378 includes respective clamp upper and lower members 380, 382. The upper and lower members 380, 382, when mated, form openings 384, 386, which admit, and secure, the brush support guide rails 370, 372. Threaded openings (not shown) present in the clamp lower members 382 may align with openings present in the clamp upper members so that screws, or other fasteners, may secure the clamp upper and lower members 380, 382 together. Slidably mounted to the brush support guide rails 370, 372 are brush linkages 390, 392, 394, 396. The brush linkages 390, 392 each have respective horizontal and vertical components 398, 400 and the brush linkages 394, 396 each have respective horizontal and vertical components 402, 404. Each of the horizontal components 398, 402 defines openings 406, 408. Disposed within each of the openings 406, 408 is a bearing insert 410. An inner or bearing surface 412 of each bearing insert 410 is disposed against each of the brush support guide rails 370, 372, thereby allowing longitudinal translation of each brush linkage 390, 392, 394, 396. An optionally unitary, or otherwise integral, extension 414 extends outboard from the horizontal component 402 of the brush linkage 396. Another extension 416 (not shown) extends outboard from the horizontal component 398 of the brush linkage 390. Cam follower brackets 420, 422 may be mounted to the respective longitudinal extensions 414, 416, e.g., by means of fasteners such as screws extending through the cam follower brackets 420, 422 and threaded into openings (not shown) in the longitudinal extensions 414, 416. A cam follower 424, 426 is attached to each of the respective cam follower brackets 420, 422. The cam followers 424, 426 are positioned and dimensioned to be accommodated in the grooves 360, 361 of the brush cams 356, 358. Brush receivers 432, 434 may be mounted to the vertical components 400, 404, respectively, e.g., by fasteners such as screws secured in the vertical components 400, 404. The brush receivers 432, 434, in the embodiments shown, have respective horizontal elements 436, 438 and vertical elements 440, 442. Brushes 446, 448 may be present within the brush receivers 432, 434, respectively. A plurality, e.g. three, of clamps 450 may be mounted, e.g., by fasteners such as screws, to the horizontal elements 436, 438 to secure the brushes 446, 448 within the brush receivers 432, 434. The brush linkages 390, 392, 394, 396 may be configured such that the brushes 446, 448 are angled to contact each other at the tips thereof. The instant brushes 446, 448 may include nylon bristles between about 0.020 and 0.030 inch in diameter. However, a person of ordinary skill in the art will recognize that other materials with other dimensions may be suitable for other embodiments. Materials suitable for other embodiments can be found in the Handbook of Plastics, Elastomers, and Composites, Third Edition, Charles A. Harper, Editor in Chief, McGraw-Hill, New York (1996), incorporated by reference above.

As described above, one or more wiper blades 310 of this invention may be disposed adjacent to the reciprocating brushes 446, 448 and may be completely independent from the brush subassembly 302. The wiper blade subassembly 300 may be spring-loaded and self-aligning by virtue of the vertical guides 330 and compound connectors 332 to evenly force the edges of the blade(s) against the full span of the surface of the cylinder being cleaned. Wiper blade forces being exerted may range from approximately 1 ounce per lineal inch to three pounds per lineal inch, depending upon the cleaning parameters chosen. The purpose of the wiper blade subassembly 300 may be to assist in removal of ink from the impression cylinder during the cleaning cycle; and to remove remnant films of cleaning fluid(s) from the cylinder at the end of the rinse cycle, thereby allowing the cylinder to dry more quickly. In one embodiment, the wiper blade subassembly 300 of this invention may be reciprocated using a motor-driven cam arrangement at an adjustable frequency of between about 1 to 20, 5 to 15, or 10 times per second at travel distances from between about 1/32 to 1/4 inch per stroke. In yet another embodiment, a motorized crank equipped with a link (not shown) may provide the desired reciprocating action. In this reciprocating motion of the wiper blade(s) is combined with rotational motion of a cylinder being cleaned such that an efficient multi-dimensional wiping pattern results. In still another embodiment, the wiper blade subassembly may be non-reciprocating, e.g., by removing the wiper cam follower 328. The wiper blade mounting arrangement of this invention may thus be designed to allow quick and simple blade replacement by removing the connectors securing the wiper blade 310 in place, replacing the wiper blade 310, then reattaching the connectors.

As further explained above, a second set of cams 312, 314 lifts and lowers the aft wiper blade assembly only. With this arrangement, the module may remain in a raised position required during all cycles of some embodiments of this invention, while the wiper blade may be independently raised and lowered as desired. During initial stages of a cleaning cycle, the wiper blade of this invention may be in a lowered position to allow the cleaning fluid to remain on the cylinder for a predetermined amount of time or number of revolutions, thus providing sufficient time for the fluid to loosen the ink from the cylinder being cleaned. Each portion of a lifting/lowering cycle may occur in a range of between about 0.01 to 1.0, 0.1 to 0.9, 0.3 to 0.8, or 0.5 second. The lifting and lowering action in both cases may be approximately vertical and each may travel in a linear fashion.

One or two reciprocating linear brushes 446, 448 may be used to remove ink from the cylinder 52 being cleaned. If two brushes 446, 448 are used, they may reciprocate approximately 180 degrees out of phase with respect to each other in order to minimize vibration and maximize effectiveness. The brushes 446, 448 may be arranged such that portions of their brush ends contact each other, so as to effect a degree of self-cleaning action on the bristle ends. This brush arrangement, particularly when used with certain cleaning fluids, may be very effective in removing ink from the cylinder as well as minimizing ink build up on the brush ends. In one embodiment, the brushes 446, 448 are reciprocated via a special motor-drive and barrel cam arrangement. One cam per brush is contemplated for certain embodiments. However, a single cam may drive both brushes as well. In yet another embodiment, a motorized crank equipped with a link arm (not shown) or similar mechanism may provide the desired reciprocating action. By virtue of the drive mechanism, each brush 446, 448 may travel a distance of approximately ⅛ to one inch linearly. At the end of its travel, and by virtue of the drive mechanism, each brushes 446, 448 reverses direction and travels back the same distance. The brush 446, 448, accordingly, may complete this "out-and-back" cycle at an adjustable frequency of approximately 1 to 20 times per second to scrub a printing cylinder. When this reciprocating motion of the brush(es) 446, 448 is combined with the rotational motion of a cylinder 52, an efficient, multi-dimensional scrubbing pattern results. This cleaning pattern is more effective than a linear scrubbing pattern resulting from using traditional rotary brush or reel-to-reel cleaning cloth methodology. Additionally, one or both of the instant brushes 446, 448 may be substituted for wiper blades when applicable. Brushes, or wiper blades, may be specially prepared for this application. However, other embodiments of this invention utilize commercially available brushes and/or wiper blades. Brush, or wiper mounts, may be designed to allow quick and simple replacement of the blades and/or wipers.

Figure 15:
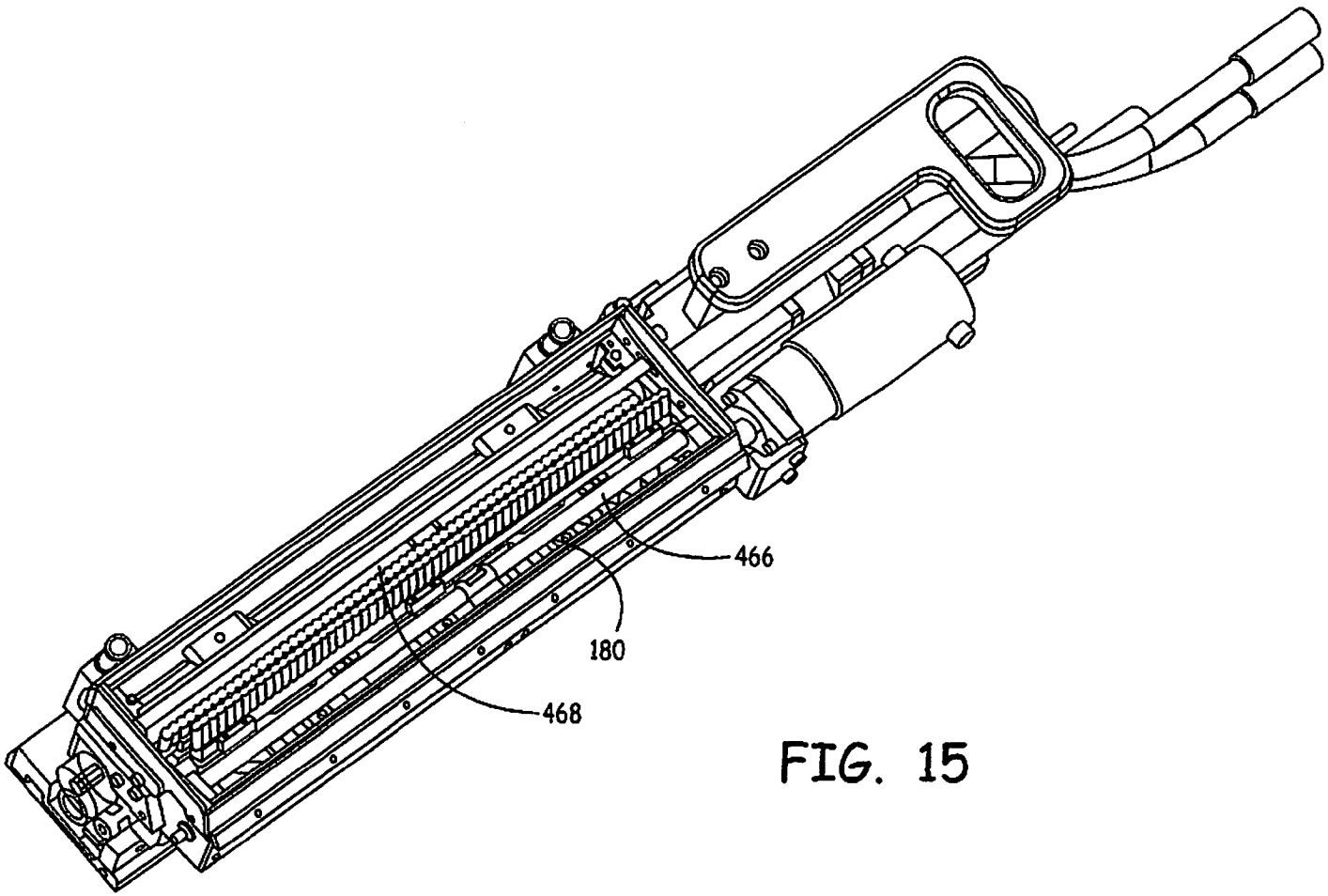
FIG. 15 is perspective view of the printing cylinder cleaning system of FIG. 1, showing the spray manifolds thereof.
Figure 16:
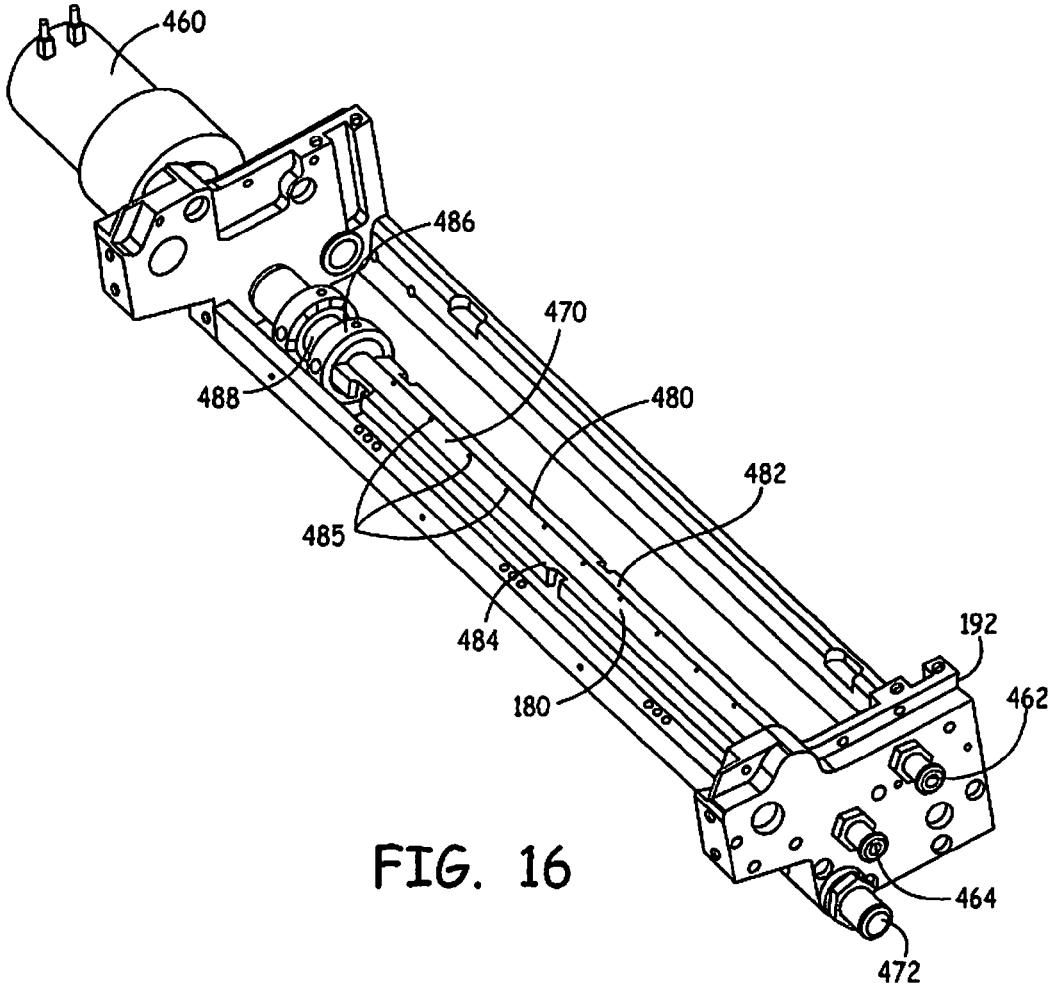
FIG. 16 is a perspective view of the auger arrangement of the printing cylinder cleaning system of FIG. 1.

As shown in FIGS. 15 and 16, the cleaning fluid supply and discharge assembly 180, in the embodiment depicted, has an auger motor 460 a plurality of, e.g., two, cleaning fluid inlets 462, 464, one or more, e.g. two, spray manifolds 466, 468, an auger subassembly 470, and a fluid (slurry) outlet 472. A suitable embodiment of the auger motor 460 has a part number of GM9413-3 and is a 12/24 VDC motor having a ratio of 65.5:1 and can be obtained from Pittman Corp. Inc., Harleyville, Pa. The auger motor 460 attaches to the end cap 194 and rotates the auger assembly 470. The cleaning fluid inlet 462 supplies fluid to the spray manifold 466. The cleaning fluid inlet 464 supplies cleaning fluid to the spray manifold 468 and the auger assembly 470, as is more fully explained below. The spray manifolds 466, 468 may define a plurality of spray openings (not shown), or alternatively may accommodate a plurality of spray nozzles (not shown), to deliver cleaning fluid to locations more fully described below. The auger subassembly 470, as shown, has an auger shaft 480, at least one, e.g. two, auger flights 482, 484, and a barrel cam 486. The auger flights 482, 484 may be either straight or spiral. The auger subassembly 470 may be mounted inside and along the bottom of the instant cleaning module. In one embodiment, the auger shaft 480 is hollow, receiving cleaning fluid from the inlet 464 and emitting the received cleaning fluid from an array of small holes 485 along the length thereof. The barrel cam 486 is attached about the auger shaft 480 and defines an angled barren cam groove 488 accommodating the wiper cam follower 328. Thus, the auger motor 460 rotates the auger subassembly 470 and reciprocates the wiper subassembly 300.

One or more internal spray manifold(s) 466, 468 may be present to apply cleaning fluid and/or water to the cylinder being cleaned, as well as to the brushes 446, 448, and/or wiper blad(es) 310. The discharge direction of the spray manifold(s) may be fully adjustable and may also be positioned to directly or indirectly apply fluid to a desired location. Another embodiment includes applying cleaning fluid directly on the cylinder being cleaned, the wiper blade(s) 310 and/or splash guard 190 alternatively preventing the spray from impinging the brushes 446, 448. Fluids dispensed from the manifold(s) 466, 468 may be individually and adjustably pressurized in the range of between about 1 to 100, 10 to 90, 20 to 80, 30 to 70, or 50 psi, or in other pressures as required. Spray emitted from manifold ports or nozzles may be stream-like, mist-like, or a combination thereof.

As seen in FIGS. 15 and 16, a motorized auger subassembly 470, having either straight or spiral flights 482, 282, may be mounted inside, and along the bottom of, the cleaning module of this invention. The auger subassembly 470 may be used to mechanically break apart larger pieces of ink removed from the cylinder. Flights 482, 484 of the auger subassembly 470 of this invention may also agitate the fluid/water/particulate slurry to encourage ink particle suspension and to enable these particulates to flow with the slurry toward the module outlet port 472, where they can be pumped out of the module and collected by means of a filter (not shown). In one embodiment, the auger shaft 480 is hollow and features an array of small openings 485 along the length thereof. Such a hollow auger shaft 480 may be supplied with water and/or cleaning fluid and may function as a rotating spray manifold. This feature may assist with additional slurry agitation and ink breakdown and thus enhance the thoroughness of the cleaning, rinsing, and drying operations. Water and/or fluid dispensed from a hollow auger shaft 480 may be adjustably pressurized in the range of between about 1 and 100, 10 and 90, 20 and 80, 30 and 70, or 50 psi and may also assist in reducing build up of ink particulates within the module cavity.

A controller 184 (not shown) may be present in some embodiments of this invention. An industrial machine control system may utilize components and methods to govern the operation of the cleaning system and its sub-cycles. The logic (controlling software) of the control system may be written specifically to chronologically dictate activation and deactivation of all cleaning module pumps, valves, and motors in order to obtain the desired sequences of the sub-cycles and components. The controller 184 may work in conjunction with the press control system to simultaneously track and/or determine the angular position and rotational speed of the impression cylinder. The machine control software may be configured to provide a wide variety of protocols and sequences, including protocols and sequences other than those described above to maintain the most effective cleaning, rinsing, and drying operations.

The cleaning operation of this invention may have three main cycles, characterized as a cleaning cycle, a rinsing cycle, and a drying cycle. The cleaning cycle may be further subdivided into soak and activated cleaning stages. The rinsing cycle may be shown subdivided into first, second, and third stages. The drying cycle may be subdivided into a removal ("squeegee") stage and an air dry stage. Specific protocols within a given cycle may be timed by a programmable machine control system.

Upon initiation of a cleaning cycle, the module 104 may be raised into position under the cylinder to be cleaned using the instant engagement-disengagement cam arrangement. Upon initiation of the cleaning cycle, and by virtue of the cam arrangement, the wiper blade may remain in a lowered position, i.e., not contacting the cylinder. Also upon initiation of the cleaning cycle, cleaning fluid may be dispensed via the manifold(s) onto the cylinder, and/or linear brush(es), and/or wiper blade(s) as required for the specific application. If a hollow auger is present, fluid may be dispensed from it as well. The resulting ink-fluid slurry may eventually collect at the bottom of the module by gravity flow. An external slurry pump may be activated to remove the slurry from the module. The slurry may be passed through an external filter to collect ink particulates, then optionally recycled for further use in cleaning. Also upon initiation of the cleaning cycle, the impression cylinder may be rotated at a predetermined speed to thereby cover the cylinder 52 with cleaning fluid. The cleaning fluid may be especially formulated with sufficient viscosity and/or tenacity so as to remain on the cylinder and to soften and loosen the ink. This stage of the cleaning cycle may be referred to as the "soak cycle." After the cleaning fluid has been applied to the cylinder and allowed to remain thereon for a predetermined amount of time, the auger 470 and reciprocating linear brush(es) 446, 448 may be activated, the cylinder thereby actively being scrubbed to remove build-up ink. This stage of the cleaning cycle may be referred to as the "activated cleaning cycle."

During passage of each of the gripper finger assemblies 56 on the impression cylinder 50, the entire module 104 may be lowered by the cam arrangement 260. Through the use of one or more solenoid valves or by other means, the flow of cleaning fluid may be halted during the passage of each of the cylinder finger wells 54. After each finger well 54 has passed, the module 104 may be again raised and the flow of fluid resumed. Normally, there may be two sets of gripper finger assemblies 54, 56 present on the cylinder 52 being cleaned. Accordingly, such module lowering and raising cycles may be made for each cylinder revolution.

After a predetermined amount of time in which the cylinder has been cleaned by the module of this invention, a rinse cycle may be initiated. Cleaning fluid and/or water may be applied to the cylinder and internal components of the module during the various stages of the rinse cycle. During a first stage of the rinse cycle (in one embodiment), the wiper blade may remain in a lowered position. Solenoid valves shut off the flow of cleaning fluid and initiate a flow of water to the manifold(s). Water and/or other cleaning fluid(s) may be sprayed onto the cylinder, linear brushes, and/or wiper blade is required and the reciprocating brushes may continue to cycle to thereby rinse all components. Also, during passage of the gripper finger well(s), the module may be lowered and the flow of fluid(s) discontinued. However, the module auger may continue to rotate during this time and a pump may continue to remove slurry from the module.

During the second stage of the rinse cycle, the wiper blade may be raised against the cylinder to remove any remaining water-fluid from the cylinder surface. The auger may remain in operation during this time and a pump may continue to remove slurry from the module.

During the third stage of the rinse cycle, water may again be applied to, and removed from, the cylinder. The wiper blade may be raised and lowered as required to rinse and dry the cylinder efficiently. After a predetermined amount of time or revolutions, the flow of water may be shut off. After an additional predetermined amount of time or revolutions, the raised wiper blade may be lowered. The auger made remain in operation during this time and a pump may continue to remove slurry from the module. At the completion of the third stage of the rinse cycle, the auger and slurry pump may continue to operate for a predetermined amount of time and are then shut off, thereby completing the rinse cycle.

At the end of the rinse cycle the wiper blade may be forced against the cylinder to remove residual water.

During the drying cycle, a solenoid valve may allow the introduction of compressed air into the sprayed manifold(s) and hollow auger the cylinder may be rotated for a predetermined amount of time or revolutions while compressed air is directed onto the cylinder surface. The compressed air may be heated if desired, or the compressed air may be used at nominal room temperature. Such an airflow may be used with, or without, raising the wiper blade to assist with cylinder drying and may be particularly effective in helping to drive areas inaccessible to the wiper blade, e.g., areas around the gripper finger wells. After a predetermined amount of time or revolutions, the airflow is shut off to complete the drying cycle.

By virtue of the components previously described (and others), embodiments of the cleaning module may include:

1. Safe Operation. The module may be designed such that all of the components located in the vicinity of the impression cylinder and gripper fingers cannot cause a damaging interference with the impression cylinder, gripper fingers, or any other press components in the event of a module malfunction.

2. Use of Non-hazardous Solvent(s). By virtue of the multi-dimensional mechanical action of the reciprocating linear brushes and wiper blade(s), the cleaning module is intended to be used with environmentally-friendly cleaning solutions, i.e., those solutions containing zero or only minimal amounts of volatile organic solvents deemed hazardous by the EPA and may be labeled as "VOC free," "Minimal VOCs," and/or "Low VOCs."

3. Efficient, reliable, and repeatable multi-directional cleaning. The multi-directional brushing and/or wiping action produced by the module design may result in an improved cleaning action.

4. Cylinder Position and Speed Requirements. By virtue of the mechanical action of the reciprocating linear brushes and wiper blade(s), and especially when the module is used in conjunction with the cleaning solution(s) appropriate for the type of ink to be removed, the cleaning operation may be effective in the 0 to 50 rpm speed range of the impression cylinder. The cylinder may be slowed or paused as desired to allow the cleaning module to work on specific areas of the cylinder known to have more buildup, for example, along the perimeter of a gripper finger "well". However, the cylinder may be rotated at some nominal minimal speed to retain some effectiveness of the "squeegee" action of the wiper blade while it is in its "raised" position.

5. Module Interchangeability. The installation of a cleaning module into a press is non-specific and interchangeable—a module may be installed under any cylinder previously equipped with a cleaning module mounting system and fluid supply system.

6. Module Installation/Removal. The installation and removal of a cleaning module from a module support system may be performed without tools.

7. Brush and Blade Installation and Removal. The installation and removal of replaceable brushes and wiper blades may be easily performed with a few common tools.

8. Module Location. One embodiment of the module may be approximately located at or between the 5 to 7 o'clock positions relative to (beneath) the impression cylinder.

9. Cleaning Module Sequence Timing. The action of the cleaning module may be timed to the press in a conventional manner by virtue of an industrial machine control system, a.k.a. "master controller." This system may be specially programmed to sequentially activate and deactivate the various module and support system components as desired to optimize the effectiveness of the cleaning system.

10. Automatic or semi-automatic cleaning cycle initiation and operation for one or more impression cylinders.

System Components

The cleaning system consists of the cleaning module, a supporting structure designed to allow the cleaning module to be quickly slid into place, and an array of pumps, solenoid valves, filters, fittings and plumbing that will be used to convey cleaning solution(s), water and air into and/or out of the module. The module equipment may also transport ink particulate removed from of the cylinder during cleaning and may collect this particulate in an external filter and/or collection tank. By virtue of the non-volatile cleaning solution(s) and the labyrinth-type splash guard, a vapor exhaust system may not be required.

Quick-disconnect electrical and fluid-handling fittings, if present, will allow the cleaning module to be easily placed into service and readily removed for servicing. During normal operation, no tools would be required to install or remove a module from the press.

When installed in the press, the cleaning module is located at approximately the 5 to 7 o'clock position relative to (beneath) the impression cylinder. Support equipment such as the fluids handling system and the control system may be located outside of the press in a convenient location.

The module may include the following concepts, features, components, and subassemblies:

1. Reciprocating Linear Brush(es). One or more reciprocating linear brushes may be used to remove ink from the cylinder. If two such brushes are used, they may reciprocate back and forth approximately 180 degrees out of phase with each other in order to minimize vibration and maximize effectiveness. The brushes may be arranged such that portions of their brush ends will be in contact with each other; such interference will effect a degree of self-cleaning action on the bristle ends. This brush arrangement, particularly when used with specially selected cleaning solutions, may be very effective for removing ink from the cylinder as well as minimizing ink build-up on the brush ends. In one embodiment, the brushes are driven back and forth via a special motor-driven barrel cam arrangement. One cam per brush is contemplated, but it is also feasible to have one cam driving both brushes. In a second embodiment, a motorized crank equipped with a link arm or a similar mechanism may provide the desired reciprocating action. By virtue of the drive mechanism, each brush would travel a distance of approximately ⅛ inch to 1 inch in a linear fashion in one embodiment. At the end of its travel and again by virtue of the drive mechanism, the brush would reverse direction and travel back the same distance. The brush would complete this "out-and-back" cycle at an adjustable frequency of approximately 1 to 20 times per second to produce the traditional "scrubbing" motion typically associated with many brushes. When this reciprocating motion of the brush(es) is combined with the rotational motion of a cylinder, an efficient, multi-dimensional scrubbing pattern would result. This cleaning pattern is more effective than the linear scrubbing pattern resulting from using traditional rotary brush or reel-to-reel cleaning cloth methodology. Note also that one or both of the brushes may be substituted with wiper blades when applicable. Brushes or wiper blades may be specially prepared for this application; however, other embodiments of this invention utilize commercially available brushes and/or wiper blades. Brush or wiper mounts may be designed to allow quick and simple replacement of the blades and/or wipers.

2. Wiper Blade(s). One (or a set of) wiper blade(s) is situated adjacent to the reciprocating brushes and is completely independent from the brush subassembly. The wiper blade subassembly may be spring-loaded and self-aligning to evenly force the edges of the blade(s) against the full span of the face of the cylinder. Wiper blade forces may range from approximately 1 ounce per lineal inch to 3 lbs per lineal inch, depending on the various cleaning parameters involved. The purpose of the wiper blade subassembly is two-fold: 1) to assist in the removal of ink from the impression cylinder during the cleaning cycle; and 2) to remove the remnant film of cleaning fluid(s) from the cylinder at the end of the rinse cycle, thereby allowing the cylinder to dry faster. In one embodiment, this wiper blade subassembly may be reciprocated using a motor-driven cam arrangement at an adjustable frequency of 1 to 20, 5-15, or 10 times per second and at travel distances from approximately 1/32 inch to ¼ inch per stroke. In a second embodiment, a motorized crank equipped with a link arm may provide the desired reciprocating action. When this reciprocating motion of the wiper blade(s) is combined with the rotational motion of a cylinder, an efficient multi-dimensional wiping pattern results. In a third embodiment, the wiper blade assembly may be non-reciprocating. The wiper blade mounting arrangement may be designed to allow quick and simple blade replacement in another embodiment of this invention.

3. Adjustable Spray Manifold(s). One or more internal spray manifold(s) may be used to apply the solution(s) and/or water to the cylinder, linear brushes, and/or wiper blades. The discharge direction of the spray manifold(s) may be fully adjustable and may be positioned to directly or indirectly apply solution onto these items in one embodiment of this invention. Another embodiment involves applying the solution(s) directly to the cylinder being cleaned, the wiper blades and/or splash guard preventing the spray from impinging the linear brushes. Fluids dispensed from the manifold(s) may be individually and adjustably pressurized in the range of approximately 1 to 100, 10-90, 20-80, 30-70, or 50 psi, or at other pressures as required. Spray emitted from manifold ports or nozzles may be stream-like, mist-like, or a variation thereof.

4. Auger. A motorized auger, featuring either straight or spiral flights, may be mounted inside and along the bottom of the cleaning module. The auger may be used to mechanically break apart larger pieces of ink removed from the cylinder. The flights of the auger would also agitate the solution/water/particulate slurry to encourage ink particle suspension and would encourage these particles to flow with the slurry towards the module's outlet port, where they may be pumped out of the module and collected in a filter. In one embodiment, the auger shaft is hollow and features an array of small holes along its length. Such a hollow auger may be supplied with water and/or solution and may function as a rotating spray manifold. This feature may assist with additional slurry agitation and ink breakdown, and may enhance the thoroughness of the cleaning, rinsing, and drying operations. Water and/or solution dispensed from a hollow auger may be adjustably pressurized in the range of approximately 1 to 100, 10-90, 20-80, 30-70, or 50 psi and may also assist in reducing a buildup of ink particulate inside the module cavity.

5. Engagement/Disengagement Subassembly. In one embodiment, a camshaft driven by a servo (or stepper) motor is the prime mover for lifting and lowering the module, as well as independently lifting and lowering some of the internal components in one of the contemplated embodiments. On this camshaft may be mounted multiple sets of cams. A first set of cams lifts and lowers the entire module into place under the impression cylinder during the cleaning, rinsing, and drying cycles. A second set of cams lifts and lowers the aft wiper blade assembly only. With this arrangement, the module may remain in the raised position required during all cycles, while the wiper blade may be independently raised and lowered as desired. During the initial stages of a cleaning cycle, this blade may be in its lowered position to allow the cleaning solution to remain on the cylinder for a predetermined number of revolutions, thus giving the solution sufficient time to loosen the ink from the cylinder. Each portion of a lift/lower cycle may occur in a range of 0.01 to 1.0, 0.1-0.9, 0.3-0.8, or 0.5 second. The lifting and lowering action in both cases are approximately vertical and each travel in a linear fashion.

The cleaning cycle is interrupted twice per cylinder revolution, in a synchronized manner and regardless of the actual rotational speed of the cylinder, to allow the gripper fingers to pass. The synchronization of the cleaning system to the rotation of the impression cylinder—and more specifically to the passage of each of the two sets of gripper fingers may be accomplished using any of the following methods:

a) The master encoder on the printing press is normally used to keep track of the rotational position of the rotating press components in general, and this includes the impression cylinder(s). The cleaning system controller may be programmed to monitor the master encoder on the press in order to coordinate the lift/lower action of the cleaning system with the gripper fingers.

b) A non-contacting proximity sensor may be used to detect the upcoming presence of the gripper fingers. The cleaning system controller may monitor the sensor to coordinate the lift/lower action of the cleaning system with the gripper fingers.

c) A limit switch may be used to mechanically "follow" the cam commonly used on most presses to actuate the gripper fingers. The cleaning system controller may monitor the limit switch to coordinate the lift/lower action of the cleaning system with the gripper fingers.

d) Other methods not specifically described above may be used to provide the necessary timing functions.

e) Any combination of the above methods or steps may be employed.

The incoming flows of cleaning solution(s), water, and air may be regulated, initiated and halted as desired by virtue of an array of valves, pumps, regulators and manifolds that make up each individual cleaning system. Due to multiple fluid inlet ports on the module and multi-ported manifold(s) in the fluids supply system, a plurality of combinations of ingoing fluid flows are possible. For example, fluid combinations such as solution/solution, solution/water, water/water, solution/air, water/air, air/air, and solution/water/air may be made available to maximize the effectiveness of the cleaning and drying capabilities of the module. The individual pressures of water, solution, and air may each be independently controlled as required to optimize cleaning performance. The various fluids may be applied in virtually unlimited ratios. Each blend of cleaning fluids may be dyed a specific color in one embodiment of this invention, thereby enabling an operator to readily ascertain whether a preferred or recommended cleaning fluid is being used to clean a printing cylinder simply by the color of the cleaning fluid.

The cleaning module of this invention may use cleaning fluids which are commercially available or custom formulated for a particular application or set of applications. Fluid(s) may also be formulated to obtain a desired blend of general characteristics such as viscosity, tenacity, ease of handling, and cleaning effectiveness. The cleaning module of this invention may thus be designed to work with cleaning fluids having minimal amounts of solvents or volatile organic compounds (VOCs) deemed hazardous, e.g., by the EPA and therefore may be well-suited to non-hazardous material disposal methods. Due to the variable parameters required to accomplish adequate cylinder cleaning, water and/or cleaning solutions may be applied at individually adjustable pressures ranging from about 1-150, 20-140, 40-120, 50-100, or 80 psi.

The end caps, side plates, trough, and spray guard assembly cooperate to confine fluids used during cleaning to within the module of this invention. Accordingly, fluids applied to a cylinder and the resulting slurry are collected within the trough by gravity flow.

A platform and set of rails may be secured to the press to allow for expedient installation and removal of the instant cleaning module. The mounting system may be designed to provide accurate and repeatable three-dimensional positioning and securement of the module relative to the impression cylinder.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. A method of cleaning a rotating press cylinder, comprising:

displacing a cleaning module from a mounting base assembly toward said press cylinder;

directing a spray of cleaning fluid from said module toward said press cylinder; and contacting said press cylinder with a reciprocating brush and a reciprocating wiper blade, said reciprocating brush and said reciprocating wiper blade extending from said module, said reciprocating brush reciprocating independently of said reciprocating wiper blade.

2. The method of claim 1, further comprising egressing said cleaning fluid from said module after said cleaning fluid has been directed toward said press cylinder.

3. The method of claim 2, in which particulates are present in said cleaning fluid and in which said particulates are suspended in said cleaning fluid.

4. The method of claim 3, in which said particulates are suspended in said cleaning fluid by a rotating auger.

5. The method of claim 3, in which said particulates are suspended in said cleaning fluid by a rotating auger delivering a spray of cleaning fluid therefrom.

6. The method of claim 1, in which displacing said cleaning module includes rotating a cam in contact with a cam follower.

7. The method of claim 1, in which a pair of reciprocating brushes contacts said press cylinder.

8. The method of claim 1, in which said brush is reciprocated by a rotating cam cooperating with a cam follower.

9. The method of claim 1, in which said wiper blade is reciprocated by a rotating cam cooperating with a cam follower.

10. The method of claim 9, in which said module comprises a cam follower mounted to a rotating auger and in which a cam is disposed in the cam follower, in which the cam follower is in mechanical communication with the wiper blade, and in which the wiper blade is reciprocated by the rotating auger.

11. The method of claim 1, in which said printing cylinder is an impression cylinder.

* * * * *